US008167596B2

(12) United States Patent
Kishikawa et al.

(10) Patent No.: US 8,167,596 B2
(45) Date of Patent: May 1, 2012

(54) COMPRESSOR AND MANUFACTURING METHOD THEREOF

(75) Inventors: Mitsuhiko Kishikawa, Sakai (JP); Takashi Hirouchi, Sakai (JP); Hiroyuki Yamaji, Sakai (JP); Mikio Kajiwara, Sakai (JP); Satoshi Yamamoto, Sakai (JP); Mie Arai, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 879 days.

(21) Appl. No.: 12/281,028

(22) PCT Filed: Mar. 2, 2007

(86) PCT No.: PCT/JP2007/054046

§ 371 (c)(1),
(2), (4) Date: Aug. 28, 2008

(87) PCT Pub. No.: WO2007/100097

PCT Pub. Date: Sep. 7, 2007

(65) Prior Publication Data

US 2009/0068046 A1 Mar. 12, 2009

(30) Foreign Application Priority Data

| | | |
|---|---|---|
| Mar. 3, 2006 | (JP) | 2006-057983 |
| Mar. 3, 2006 | (JP) | 2006-057984 |
| May 17, 2006 | (JP) | 2006-137163 |
| May 17, 2006 | (JP) | 2006-137164 |

(51) Int. Cl.

| | |
|---|---|
| ***F01C 21/00*** | (2006.01) |
| ***F04C 15/00*** | (2006.01) |
| ***B23P 15/00*** | (2006.01) |

(52) U.S. Cl. .... 418/179; 418/55.1; 418/55.2; 29/888.02

(58) Field of Classification Search ..... 418/179, 418/55.1, 243, 259, 11, 12; 29/888.02
See application file for complete search history.

(56) References Cited

U.S. PATENT DOCUMENTS

| | | | | |
|---|---|---|---|---|
| 5,423,664 | A * | 6/1995 | Iizuka et al. | 418/179 |
| 5,532,454 | A | 7/1996 | Kuhnen | |
| 6,136,101 | A | 10/2000 | Sugawara et al. | |
| 2001/0015013 | A1 | 8/2001 | Kato et al. | |
| 2004/0158984 | A1 | 8/2004 | Lundgren | |
| 2005/0169787 | A1 * | 8/2005 | Iguchi et al. | 418/55.1 |

FOREIGN PATENT DOCUMENTS

| | | | |
|---|---|---|---|
| EP | 0 221 752 | A2 | 5/1987 |
| JP | 61-273275 | A | 12/1986 |

(Continued)

OTHER PUBLICATIONS

Russian Decision of Grant of corresponding Russian Application No. 2008139291/06.

(Continued)

*Primary Examiner* — Mary A Davis
(74) *Attorney, Agent, or Firm* — Global IP Counselors

(57) ABSTRACT

The compressor includes a first constituent element and a first slider. The first constituent element is capable of being laser welded. The first slider is composed of cast iron capable of being laser welded and having a carbon content of from 2.0 wt % or more to 2.7 wt % or less. This first slider is joined to the first constituent element by laser welding without using a filler.

8 Claims, 24 Drawing Sheets

FOREIGN PATENT DOCUMENTS

| | | | |
|---|---|---|---|
| JP | 62-048986 | A | 3/1987 |
| JP | 62-101392 | A | 5/1987 |
| JP | 62-263859 | A | 11/1987 |
| JP | 2-140486 | A | 5/1990 |
| JP | 04-164181 | A | 6/1992 |
| JP | 05-099183 | A | 4/1993 |
| JP | 5-169193 | A | 7/1993 |
| JP | 06-307363 | A | 11/1994 |
| JP | 07-178584 | A | 7/1995 |
| JP | 07-185853 | A | 7/1995 |
| JP | 10-195586 | A | 7/1998 |
| JP | 2000-176663 | A | 6/2000 |
| JP | 2000-348618 | A | 12/2000 |
| JP | 2001-115966 | A | 4/2001 |
| JP | 2001-227465 | A | 8/2001 |
| JP | 2001-334378 | A | 12/2001 |
| JP | 2002-195171 | A | 7/2002 |
| JP | 2002-312420 | A | 10/2002 |
| JP | 2003-97471 | A | 4/2003 |
| JP | 2004-90069 | A | 3/2004 |
| JP | 2005-36693 | A | 2/2005 |
| JP | 2005-40853 | A | 2/2005 |
| JP | 2005-152924 | A | 6/2005 |
| JP | 2005-220752 | A | 8/2005 |
| RU | 2136464 | C1 | 9/1999 |
| WO | WO-03/020469 | A1 | 3/2003 |

OTHER PUBLICATIONS

Lundgren, RU-2287418-C2, Abstract Only, Published Nov. 20, 2006.

* cited by examiner

COMPRESSOR AND MANUFACTURING METHOD THEREOF

CROSS-REFERENCE TO RELATED APPLICATIONS

This U.S. National stage application claims priority under 35 U.S.C. §119(a) to Japanese Patent Application Nos. 2006-057983, filed in Japan on Mar. 3, 2006, 2006-057984, filed in Japan on Mar. 3, 2006, 2006-137163, filed in Japan on May 17, 2006, and 2006-137164, filed in Japan on May 17, 2006, the entire contents of which are hereby incorporated herein by reference.

TECHNICAL FIELD

The present invention relates to a compressor, and particularly to a compressor that has been reduced in size (reduced in diameter).

BACKGROUND ART

In the past, a technique has been proposed in which "the joined surface between a housing and a fixed scroll is divided into a sealed surface and a welded surface by being formed in a stepped formation, and laser welding is performed across the entire external periphery of the welded surface to join the housing and the fixed scroll together" (see Japanese Laid-open Patent Application No. 2002-195171, for example). A technique for laser welding has also been proposed in the past, in which "a pure nickel thin film is sandwiched between cast iron and steel, and the steel side is irradiated with laser light to weld the cast iron and steel" (see Japanese Laid-open Patent Application No. 2001-334378, for example).

SUMMARY OF THE INVENTION

Problems to be Solved by the Invention

Recently, particularly in Japanese society, there is a demand for air conditioning devices, water heaters, and other such devices to be reduced in size because of the difficulty in ensuring installation space and the like. To achieve this size reduction, it is unavoidable that the size of the compressor must be reduced, which belongs to a class of the larger of the element components.

In view of this, an example of a method for joining the constituent elements under consideration is to switch from "bolting" performed in the past to "laser welding." If the joining method is switched from "bolting" to "laser welding," the portions provided for the purpose of bolting can be entirely excluded, and it therefore becomes possible to reduce the size (reduce the diameter) of the compressor. Moreover, since there is no longer a need for the materials previously used in the portions provided for the purpose of bolting, this method also has the merit of reducing material costs. However, when laser welding is performed as in the technique described above, if the sealed surface and the welded surface are separated, gaps of several tens of micrometers will inevitably be formed by machining in the welded surface. Therefore, problems arise with the occurrence of undercutting and with unstable welding quality if a filler is not used. However, if nickel or another such filler is used, the nickel itself is expensive, and it may therefore not be possible to see a sufficient reduction in material costs as described above.

In cases in which carbon steel is welded, carbon steel having a carbon content of 0.3 wt % or less is usually selected.

However, since the compressor has many sliders, there are circumstances in which materials having a high carbon content are preferred in order to ensure slideability. The carbon content is preferably as high as possible also because if the carbon content is low, the materials lack machinability.

An object of the present invention is to provide a compressor that can be reduced in size, that can be made commercially available at a low price, and that does not lose conventional slideability and machinability.

Means for Solving the Problem

The compressor according to a first aspect comprises a first constituent element and a first slider. The first constituent element is capable of being laser welded. The first slider is composed of cast iron capable of being laser welded and having a carbon content of from 2.0 wt % or more to 2.7 wt % or less. The phrase "cast iron capable of being laser welded and having a carbon content of from 2.0 wt % or more to 2.7 wt % or less" as used herein refers to, e.g., cast iron or the like that is rapidly cooled and entirely chilled, and is then heat treated so that the tensile strength is from 600 MPa or more to 900 MPa or less, resulting in the formation of a refined metal structure. In other words, this first slider is equivalent to a component that is formed by semi-molten die casting, semi-solid die casting, or another such method, and is then heat treated. Since this type of first slider exhibits high tensile strength and durability, the degree of freedom in the design can be improved, and the compressor can be reduced in diameter. If the hardness is adjusted to a range from higher than HRB 90 to less than HRB 100, "breaking-in" can occur as soon as possible when the compressor is operating, and seizing can be prevented during abnormal operation. Furthermore, since this type of first slider has higher toughness in comparison with FC material, damage is less likely to occur with regard to inclusion of foreign matter and a sudden increase in internal pressure. Even if damage were to occur, small scrapings are not likely to be produced and pipes do not need to be cleaned. The term "refined" used herein refers to the metal structure being finer than that of flake graphite cast iron. This first slider is joined with the first constituent element by laser welding without using a filler. The constituent element may be a slider different from the first slider, and may also be a non-slider. The term "slider" used herein refers to, e.g., the fixed scroll or housing (bearing portion) of a scroll compressor, the cylinder block of a rotary compressor, or the like. During laser welding, the laser light is preferably adjusted so that the amount of heat input per unit length in the direction in which welding progresses is from 10 (J/mm) or greater to 70 (J/mm) or less. This is because, if the amount of heat input is less than 10 (J/mm), the depth of fusion is too small to achieve sufficient joining, and if the amount of heat input is greater than 70 (J/mm), problems are encountered in that the tensile strength of the cast iron decreases by about 30 to 40 percent, and the fatigue strength also decreases. According to the results of the inventors' experiments, the tensile strength of the cast iron in the laser welded portions can be maintained at 80 percent or greater if the amount of heat input is within this range, and it was learned in a plane bending test that a ratio of fatigue limit to cast iron strength of 0.4 to 0.5 can be achieved. The laser light is also preferably fiber laser light. This is because deep penetration is achieved during laser welding, and low heat input joining is therefore possible. The laser light also preferably has a spot diameter of from 0.2 mm or greater to 0.7 mm or less. This is because if the spot diameter is less than 0.2 mm, penetration is likely to be unsatisfactory due to deviations from the welded positions, and if the spot diameter is greater than 0.7 mm, the required depth of penetration is not achieved. The treatment speed must be reduced in order to achieve the required depth of penetration. However, if the treatment speed is reduced, the heat-affected portion becomes larger, and a problem arises in that the tensile strength of this portion decreases.

In this compressor, the first slider, which is composed of cast iron capable of being laser welded and having a carbon content of from 2.0 wt % or more to 2.7 wt % or less, is joined with the first constituent element by laser welding. Therefore, with this compressor, bolting is unnecessary, size reduction (diameter reduction) is possible, and conventional slideability and machinability are not lost. Material costs can be sufficiently reduced because the portions provided for the purpose of bolting can be excluded, and because a filler such as nickel is not used in laser welding. Consequently, this compressor can be reduced in size, can be made commercially available at a low price, and does not lose conventional slideability or machinability.

The compressor according to a second aspect is the compressor according to the first aspect, wherein the first constituent element has a first joining surface. The first slider has a second joining surface. The first joining surface and the second joining surface preferably have a center line surface roughness (Ra) of 1.2 μm or less and a degree of flatness of 0.3 mm or less. This is because the occurrence of gaps between the first joining surface and the second joining surface can be prevented, as can the occurrence of welding defects. If the joining surfaces are pressed together with great force in order to reduce the gaps, problems arise in which strain occurs in the first slider and the first constituent element, and the performance and reliability of the compressor is reduced. 50% or more of the contact portion between the first joining surface and the second joining surface is laser welded without using a filler. It is more preferable to laser weld substantially the entire contact portion between the first joining surface and the second joining surface. This is because points of fatigue breakdown can be eliminated. For the laser welding, it is preferable to use laser light having a spot diameter of from 0.2 mm or greater to 0.7 mm or less. This is because penetration defects resulting from welding position deviations can therefore be prevented.

In this compressor, the 50% or more of the contact portion between the first joining surface and the second joining surface is laser welded. In other words, in this compressor, the welded surface and the sealed surface are the same. Therefore, the compressor can be reduced in size (reduced in diameter), and the welding quality between the first constituent element and the first slider can be increased. With this compressor, laser welding is performed without using a filler. Therefore, this compressor can be made commercially available at a low price. Consequently, this compressor can be reduced in size, the welding quality can be improved between the housing or other constituent elements and the fixed scroll or the like, and the compressor can be made commercially available at a low price.

The compressor according to a third aspect is the compressor according to the second aspect, wherein the laser welding involves welding the contact portion between the first joining surface and the second joining surface across the entire periphery thereof.

With this compressor, the contact portion between the first joining surface and the second joining surface is welded across the entire periphery thereof during laser welding. Therefore, with this compressor, a reliable seal can be achieved in comparison with bolting, and an improvement in performance can be expected.

The compressor according to a fourth aspect is the compressor according to the second or third aspect, wherein the first constituent element is subjected to chamfering in an end portion of the first joining surface on the side irradiated with laser light, the chamfering being greater than 0 mm and ¼ or less of a spot diameter of the laser light. The first slider is also subjected to chamfering in an end portion of the second joining surface on the side irradiated with laser light, the chamfering being greater than 0 mm and ¼ or less of a spot diameter of the laser light.

In some cases, a certain line is photographed by a camera, and this line is used as a reference to determine the positions irradiated with laser light. In this compressor, chamfering is performed in an end portion of the first joining surface on the side irradiated with laser light in the first constituent element. In the first slider, chamfering is performed in an end portion of the second joining surface on the side irradiated with laser light. Therefore, a line at the top or bottom of a chamfered joining surface can be used as a reference line. In this compressor, the extent of chamfering is greater than 0 mm, and ¼ or less of the spot diameter of the laser light. Therefore, in this compressor, it is possible to prevent positional deviations of laser light or positional deviations of the focal point.

The compressor according to a fifth aspect is the compressor according to any of the second through fourth aspects, wherein the first constituent element has a first plate part and a first enclosing wall part. The first enclosing wall part is formed upright on the first plate part. The first joining surface is an end surface of the first enclosing wall part on the side opposite from the side of the first plate part. The first slider has a second plate part and a second enclosing wall part. The second enclosing wall part is formed upright on the second plate part. The second joining surface is an end surface of the second enclosing wall part on the side opposite from the side of the second plate part.

In this compressor, the first joining surface is the end surface of the first enclosing wall part on the side opposite from the side of the first plate part, and the second joining surface is the end surface of the second enclosing wall part on the side opposite from the side of the second plate part. Therefore, the compressor can be reduced in size (reduced in diameter) without concern for bolt fastening torque, missed bolt attachments, internal contamination of the bolts, or the like.

The compressor according to a sixth aspect is the compressor according to the fifth aspect, further comprising a second slider. The second slider is accommodated in a space formed by the first enclosing wall part and the second enclosing wall part in a state in which the first joining surface and the second joining surface are made to face each other. The first constituent element further has a third wall part. The third wall part has a surface that intersects the direction of laser light propagation during laser welding. The third wall part is also provided between the inner wall surface of the first enclosing wall part and the second slider in a state in which the first joining surface and the second joining surface are made to face each other.

In this compressor, the third wall part is provided between the inner wall surface of the first enclosing wall part and the second slider in a state in which the first joining surface and the second joining surface are made to face each other. Therefore, in this compressor, when the first constituent element and the first slider are laser welded, droplets can be prevented from being sprayed out into the inner space of the first enclosing wall part and being deposited on the second slider.

The compressor according to a seventh aspect is the compressor according to the fifth aspect, further comprising a second slider. The second slider is accommodated in a space formed by the first enclosing wall part and the second enclosing wall part in a state in which the first joining surface and the second joining surface are made to face each other. The first slider further has a fourth wall part. The fourth wall part has a surface that intersects the direction of laser light propagation during laser welding. The fourth wall part is also provided between the inner wall surface of the second enclosing wall part and the second slider.

In this compressor, the fourth wall part is provided between the inner wall surface of the second enclosing wall part and the second slider in a state in which the first joining surface and the second joining surface are made to face each other. Therefore, in this compressor, when the first constituent element and the first slider are laser welded, droplets can be prevented from being sprayed out into the inner space of the second enclosing wall part and being deposited on the second slider.

The compressor according to an eighth aspect is the compressor according to the first aspect, further comprising a crankshaft and a roller. The term "roller" used herein includes the roller portion of a piston in a swing compressor, the roller of a rotary compressor, or the like. The crankshaft has an eccentric shaft portion. The roller is fitted over the eccentric shaft portion. The first slider is a cylinder block. The cylinder block has a cylinder hole. The eccentric shaft portion and the roller are accommodated in the cylinder hole. The first constituent element is a head. The head covers at least one side of the cylinder hole, the head being joined to the cylinder block by laser welding at positions corresponding to positions separated outward by a distance of from 2 mm or more to 4 mm or less from the internal peripheral surface of the cylinder hole. The term "head" used herein includes front heads, rear heads, middle plates, and the like.

In conventional swing compressors and rotary compressors, a cylinder block, a front head, a rear head, and other such components are joined by bolts to form a compression mechanism (see Japanese Laid-open Patent Application No. 6-307363, for example).

However, in cases in which bolting is used in this manner, straining occurs in the compression mechanism if there is a small number of bolts. Particularly in cases in which carbon dioxide, which has been widely used recently, or another such natural refrigerant is used as the refrigerant, pressure resistance must be ensured, and therefore the joining strength must be increased and joining strain occurs readily. Of course, such problems are resolved with a large number of bolts, but this is undesirable because the cost of bolts rises quickly.

Recently, particularly in Japanese society, there has emerged a demand for air conditioning devices, water heaters, and other such devices to be reduced in size because of the difficulty in ensuring installation space and the like. To achieve this size reduction, it is unavoidable that the size of the compressor must be reduced, which belongs to a class of the larger of the element components.

To overcome such problems, in this compressor, the head is joined to the cylinder block by laser welding at positions corresponding to positions separated outward by a distance of from 2 mm or more to 4 mm or less from the internal peripheral surface of the cylinder hole. Therefore, in this compressor, the head can be joined to the cylinder block without using bolts to create a compression mechanism. Consequently, the first head can be joined nearer to the cylinder hole than is possible in cases in which bolting is used. As a result, with this compressor, the occurrence of joining strain due to bolting can be prevented, and the compressor can be reduced in size. Consequently, with this compressor, strain can be eliminated in the compression mechanism while the manufacturing costs are reduced, and, moreover, the compressor can be reduced in diameter.

The compressor according to a ninth aspect is the compressor according to the eighth aspect, wherein the head is made thinner to be capable of being joined by penetration laser welding at positions corresponding to positions separated outward by a distance of from 2 mm or more to 4 mm or less from the internal peripheral surface of the cylinder hole. The term "making thinner" describes the reduction of thickness to 3 mm or less, in cases in which the head is manufactured by semi-molten die casting, and the laser output during penetration laser welding is 4 to 5 kW.

With this compressor, the head is made thinner to be capable of being joined by penetration laser welding at positions corresponding to positions separated outward by a distance of from 2 mm or more to 4 mm or less from the internal peripheral surface of the cylinder hole. Therefore, in this compressor, the head can be joined by penetration laser welding to the cylinder block.

The compressor according to a tenth aspect is the compressor according to the first aspect, further comprising a crankshaft and a roller. The term "roller" used herein includes the roller portion of a piston in a swing compressor, the roller of a rotary compressor, or the like. The crankshaft has an eccentric shaft portion. The roller is fitted over the eccentric shaft portion. The first slider is a cylinder block. The cylinder block has a cylinder hole and a thermal insulation space. The cylinder hole accommodates the eccentric shaft portion and the roller. The thermal insulation space is formed in the external periphery of the cylinder hole. The thermal insulation space is preferably formed as notches in the first surface in the direction through the cylinder hole in positions separated outward by more than 4 mm from the internal peripheral surface of the cylinder hole, and are formed so that a joining part is formed in a second surface side, which is the end surface on the side opposite from the first surface. This is because the cylinder block can thus be joined easily to the head. At this time, the cylinder block is preferably joined to a second head by the penetration laser welding of the joining part. In such cases, the joining part must be made thinner to be capable of being joined by penetration laser welding. The first constituent element is a head. The head covers the cylinder hole and the thermal insulation space. This head is laser welded to the cylinder block at position corresponding to areas between the cylinder hole and the thermal insulation space. The head is preferably also laser welded to the cylinder block at position corresponding to position farther out than the thermal insulation space. This is because the thermal insulation space can then be satisfactorily sealed.

The cylinder block and the head are preferably formed by semi-molten die casting. This is because good breaking-in characteristics are imparted to the cylinder block and the roller, sufficient compression strength is obtained in the cylinder block and head, as well as other characteristics; a near-net-shape can be obtained during formation, and it is easier to form the thermal insulation space than with conventional sand casting.

In the past, it has been proposed that the thermal insulation space be formed farther outward than the cylinder chamber in a swing compressor, a rotary compressor, or the like, for the purpose of reducing the amount of heat that reaches the low-temperature intake gas via the cylinder block from the refrigerant gas compressed to a high temperature in the cylinder chamber; and improving the volumetric efficiency of the compressor (see Japanese Laid-open Patent Application No. 5-99183, for example).

However, in cases in which the thermal insulation space is thus formed farther outward than the cylinder chamber, some nonuniformity in volumetric efficiency may occur among the manufactured products depending on the degree of airtightness between the head and the cylinder block.

To overcome such problems, in this compressor, the head is laser welded to the cylinder block at position corresponding to areas between the cylinder hole and the thermal insulation space. Therefore, in this compressor, a substantially complete seal is achieved between the cylinder hole and the thermal insulation space. Since laser welding eliminates the need for bolts, the cylinder can be made smaller, and the heat transfer area also decreases. Therefore, this compressor makes it possible to reduce nonuniformity in the volumetric efficiency among the manufactured products.

The compressor according to an eleventh aspect is the compressor according to the tenth aspect, wherein the head is laser welded to the cylinder block at position corresponding to areas between the cylinder hole and the thermal insulation space and at position corresponding to areas farther out than the thermal insulation space.

In this compressor, the head is laser welded to the cylinder block at position corresponding to areas between the cylinder hole and the thermal insulation space and at position corresponding to areas farther out than the thermal insulation space. Therefore, in this compressor, not only can sealing be ensured between the cylinder hole and the thermal insulation space, but airtightness can also be ensured in the thermal insulation space.

The compressor according to a twelfth aspect is the compressor according to any of the eighth through eleventh aspects, wherein the laser welding penetrates through the head. In such cases, the head must be made thinner to be capable of being joined by penetration laser welding at the portions joined with the cylinder block. The term "made thinner" describes the reduction of thickness to 3 mm or less, in cases in which the laser output during penetration laser welding is 4 to 5 kW.

In this compressor, the laser welding penetrates through the head. Therefore, in this compressor, a satisfactory seal is achieved between the cylinder hole and the thermal insulation space.

The compressor according to a thirteenth aspect is the compressor according to the first aspect, comprising a crankshaft and a roller. The crankshaft has an eccentric shaft portion. The roller is fitted over the eccentric shaft portion. The first slider is a cylinder block. The cylinder block has a cylinder hole. The eccentric shaft portion and the roller are accommodated in the cylinder hole. The first constituent element is a head. The head is joined to the cylinder block by penetration laser welding, and the head covers at least one side of the cylinder hole.

In this compressor, the head is joined to the cylinder block by penetration laser welding, and the head covers at least one side of the cylinder hole. Therefore, with this compressor, the head can be joined to the cylinder block without using bolts, and a compression mechanism can be created. Consequently, with this compressor, it is possible to prevent the occurrence of joining strain caused by bolting, and the compressor can be reduced in diameter. As a result, with this compressor, strain can be eliminated in the compression mechanism while the manufacturing costs are reduced, and, moreover, the compressor can be reduced in diameter.

The compressor according to a fourteenth aspect is the compressor according to any of the eighth through thirteenth aspects, wherein the head is joined to the cylinder block by penetration laser welding along the axial direction of the crankshaft.

In this compressor, the head is joined to the cylinder block by penetration laser welding along the axial direction of the crankshaft. Therefore, in this compressor, a first head can be easily joined to the cylinder block.

The compressor according to a fifteenth aspect is the compressor according to any of the eighth through thirteenth aspects, wherein the head is joined to the cylinder block by penetration laser welding along a direction that intersects the axial direction of the crankshaft (excluding the direction orthogonal to the axial direction of the crankshaft).

In this compressor, the head is joined to the cylinder block by penetration laser welding along a direction that intersects the axial direction of the crankshaft (excluding the direction orthogonal to the axial direction of the crankshaft). Therefore, in this compressor, the head can be easily joined to the cylinder block.

The compressor according to a sixteenth aspect is the compressor according to any of the first through fifteenth aspects, wherein carbon dioxide is compressed.

In cases in which carbon dioxide or another such high-pressure refrigerant is compressed in a compressor in which the first constituent element and the first slider are bolted in a usual aspect, the refrigerant or the like leaks from the joining parts because the joining strength is insufficient, and in cases in which the compressor is a scroll compressor, uneven strain occurs in the scroll portion of the scroll. However, in the compressor according to the present invention, the first constituent element and the first slider are firmly joined by laser welding. Therefore, with this compressor, such problems do not occur even in cases in which carbon dioxide is used as the refrigerant. The first constituent element and the first slider are preferably laser welded across the entire periphery thereof.

The method for manufacturing a compressor according to a seventeenth aspect is a method for manufacturing a compressor having a crankshaft that has an eccentric shaft portion; a roller fitted over the eccentric shaft portion; a cylinder block that has a cylinder hole for accommodating the eccentric shaft portion and the roller; and a head for covering the cylinder hole; the method comprising a contact step and a laser welding step. In the contact step, the head is brought in contact with the cylinder block so as to cover the cylinder hole. In the laser welding step, the head is laser welded to the cylinder block at positions corresponding to positions separated outward by a distance of from 2 mm or more to 4 mm or less from the internal peripheral surface of the cylinder hole.

In this method for manufacturing a compressor, in the laser welding step, the head is laser welded to the cylinder block at positions corresponding to positions separated outward by a distance of from 2 mm or more to 4 mm or less from the internal peripheral surface of the cylinder hole. Therefore, when this method for manufacturing a compressor is implemented, a first head can be joined to the cylinder block without using bolts to create a compression mechanism. Consequently, when this method for manufacturing a compressor is implemented, the occurrence of joining strain caused by bolting can be prevented, and the compressor can be reduced in diameter. As a result, when this method for manufacturing a compressor is implemented, strain can be eliminated in the compression mechanism while the manufacturing costs are reduced, and, moreover, the compressor can be reduced in diameter.

The method for manufacturing a compressor according to an eighteenth aspect is a method for manufacturing a compressor having a crankshaft having an eccentric shaft portion, a roller fitted over the eccentric shaft portion, a cylinder block having a cylinder hole for accommodating the eccentric shaft portion and the roller, and a head for covering the cylinder hole; the method comprising a contact step and a penetration laser welding step. In the contact step, the head is brought in contact with the cylinder block so as to cover the cylinder hole. In the penetration laser welding step, the head is joined by penetration laser welding to the cylinder block.

In this method for manufacturing a compressor, in the penetration laser welding step, the head is joined by penetration laser welding to the cylinder block. Therefore, when this method for manufacturing a compressor is implemented, a first head can be joined to the cylinder block without using bolts to create a compression mechanism. Consequently, when this method for manufacturing a compressor is implemented, the occurrence of joining strain caused by bolting can be prevented, and the compressor can be reduced in diameter. As a result, when this method for manufacturing a compressor is implemented, strain can be eliminated in the compression mechanism while the manufacturing costs are reduced, and, moreover, the compressor can be reduced in diameter.

The method for manufacturing a compressor according to a nineteenth aspect comprises a first insertion step, a first joining step, a second joining step, a third joining step, a second insertion step, a third insertion step, a fourth joining step, and a fifth joining step. In the first insertion step, a first head, a first cylinder block having a cylinder hole, and a first middle plate are positioned on (e.g., slid onto) a crankshaft having a first eccentric shaft portion and a second eccentric shaft portion so that the first eccentric shaft portion is accommodated in the cylinder hole, and the first middle plate is positioned between the first eccentric shaft portion and the second eccentric shaft portion. In other words, the crankshaft is inserted through these other parts. In the first joining step, the first head is joined by penetration laser welding to the first cylinder block. In the second joining step, the first middle plate is joined by penetration laser welding to the first cylinder block. Either one of the first joining step and the second joining step may be performed before the first insertion step. In the third joining step, a second middle plate is joined by penetration laser welding to a second cylinder block, and a second cylinder block joined with a middle plate is created. In the second insertion step, the crank shaft is inserted into second cylinder block joined with a middle plate from the second eccentric shaft portion side so that the first middle plate and the second middle plate face each other. In the third insertion step, the crank shaft is inserted into a second head from the second eccentric shaft portion side. In the fourth joining step, the second head is joined by penetration laser welding to the second cylinder block. In the fifth joining step, the first middle plate and the second middle plate are laser welded and joined together. The fifth joining step may be performed before the third insertion step or the fourth joining step.

When this method for manufacturing a compressor is implemented, in the first insertion step, a first head, a first cylinder block having a cylinder hole, and a first middle plate are inserted through a crankshaft having a first eccentric shaft portion and a second eccentric shaft portion so that the first eccentric shaft portion is accommodated in the cylinder hole, and the first middle plate is positioned between the first eccentric shaft portion and the second eccentric shaft portion. In the first joining step, the first head is joined by penetration laser welding to the first cylinder block. In the second joining step, the first middle plate is joined by penetration laser welding to the first cylinder block. In the third joining step, a second middle plate is joined by penetration laser welding to a second cylinder block, and a second cylinder block joined with a middle plate is created. In the second insertion step, the second cylinder block joined with a middle plate is inserted from the second eccentric shaft portion side so that the first middle plate and the second middle plate face each other. In the third insertion step, a second head is inserted from the second eccentric shaft portion side. In the fourth joining step, the second head is joined by penetration laser welding to the second cylinder block. In the fifth joining step, the first middle plate and the second middle plate are laser welded and joined together. Therefore, when this method for manufacturing a compressor is implemented, a two-cylinder type compression mechanism can be created without using bolts. When this method for manufacturing a compressor is implemented, the occurrence of joining strain caused by bolting can be prevented, and the compressor can be reduced in diameter. Consequently, when this method for manufacturing a compressor is implemented, strain can be eliminated in the compression mechanism while the manufacturing costs are reduced, and, moreover, the compressor can be reduced in diameter.

Effects of the Invention

The compressor according to the first aspect can be reduced in size, can be made commercially available at a low cost, and does not lose conventional slideability or machinability.

The compressor according to the second aspect can be reduced in size, the welded quality of the housing and other constituent elements and the fixed scroll and the like can be improved, and the compressor can be made commercially available at low cost.

In the compressor according to the third aspect, a more reliable seal can be achieved than with bolting, and an improvement in performance can be expected.

In the compressor according to the fourth aspect, a line at the top or bottom of the chamfered joining surface can be used as a reference line. In this compressor, the extent of the chamfering is greater than 0 mm, and ¼ or less of the spot diameter of the laser light. Therefore, in this compressor, positional deviations of laser light or positional deviations of the focal point can be prevented.

The compressor according to the fifth aspect can be reduced in size (reduced in diameter) without concern for bolt fastening torque, missed bolt attachments, internal contamination of the bolts, or the like.

In the compressor according to the sixth aspect, when the first constituent element and the first slider are laser welded, droplets can be prevented from being sprayed out into the inner space of the first enclosing wall part and being deposited on the second slider.

In the compressor according to the seventh aspect, when the first constituent element and the first slider are laser welded, droplets can be prevented from being sprayed out into the inner space of the second enclosing wall part and being deposited on the second slider.

In the compressor according to the eighth aspect, the head can be joined to the cylinder block without using bolts to create a compression mechanism. Consequently, in this compressor, the head can be joined nearer to the cylinder hole than in cases in which bolting is used. As a result, with this compressor, the occurrence of joining strain caused by bolting can be prevented, and the compressor can be reduced in diameter.

Consequently, with this compressor, strain can be eliminated in the compression mechanism while the manufacturing costs are reduced, and, moreover, the compressor can be reduced in diameter.

In the compressor according to the ninth aspect, the head can be joined by penetration laser welding to the cylinder block.

In the compressor according to the tenth aspect, a substantially complete seal is achieved between the cylinder hole and the thermal insulation space. Since laser welding eliminates the need for bolts, the cylinder can be made smaller, and the heat transfer area also decreases. Therefore, this compressor makes it possible to reduce nonuniformity in the volumetric efficiency among the manufactured products.

In the compressor according to the eleventh aspect, not only can a seal be ensured between the cylinder hole and the thermal insulation space, but airtightness can also be ensured in the thermal insulation space.

In the compressor according to the twelfth aspect, satisfactory sealing is achieved between the cylinder hole and the thermal insulation space.

In the compressor according to the thirteenth aspect, the first head can be joined to the cylinder block without using bolts to create a compression mechanism. Therefore, with this compressor, the occurrence of joining strain caused by bolting can be prevented, and the compressor can be reduced in diameter. As a result, with this compressor, strain can be eliminated in the compression mechanism while the manufacturing costs are reduced, and, moreover, the compressor can be reduced in diameter.

In the compressor according to the fourteenth aspect, the head can be easily joined to the cylinder block.

In the compressor according to the fifteenth aspect, the first head can be easily joined to the cylinder block.

In the compressor according to the sixteenth aspect, since the first constituent element and the first slider are firmly joined by laser welding, the refrigerant or the like does not leak from the joining parts and there is no uneven strain or the like in the scroll portion of the scroll, even in cases in which carbon dioxide is used as the refrigerant.

When the method for manufacturing a compressor according to the seventeenth aspect is implemented, a first head can be joined to the cylinder block without using bolts to create a compression mechanism. Consequently, when this method for manufacturing a compressor is implemented, the occurrence of joining strain caused by bolting can be prevented, and the compressor can be reduced in diameter. As a result, when this method for manufacturing a compressor is implemented, strain can be eliminated in the compression mechanism while the manufacturing costs are reduced, and, moreover, the compressor can be reduced in diameter.

When the method for manufacturing a compressor according to the eighteenth aspect is implemented, the first head can be joined to the cylinder block without using bolts to create a compression mechanism. Consequently, when this method for manufacturing a compressor is implemented, the occurrence of joining strain caused by bolting can be prevented, and the compressor can be reduced in diameter. As a result, when this method for manufacturing a compressor is implemented, strain can be eliminated in the compression mechanism while the manufacturing costs are reduced, and, moreover, the compressor can be reduced in diameter.

When the method for manufacturing a compressor according to the nineteenth aspect is implemented, a two-cylinder type compression mechanism can be created without using bolts. When this method for manufacturing a compressor is implemented, the occurrence of joining strain caused by bolting can be prevented, and the compressor can be reduced in diameter. Consequently, when this method for manufacturing a compressor is implemented, strain can be eliminated in the compression mechanism while the manufacturing costs are reduced, and, moreover, the compressor can be reduced in diameter.

DETAILED DESCRIPTION OF THE INVENTION

First Embodiment

Figure 1:
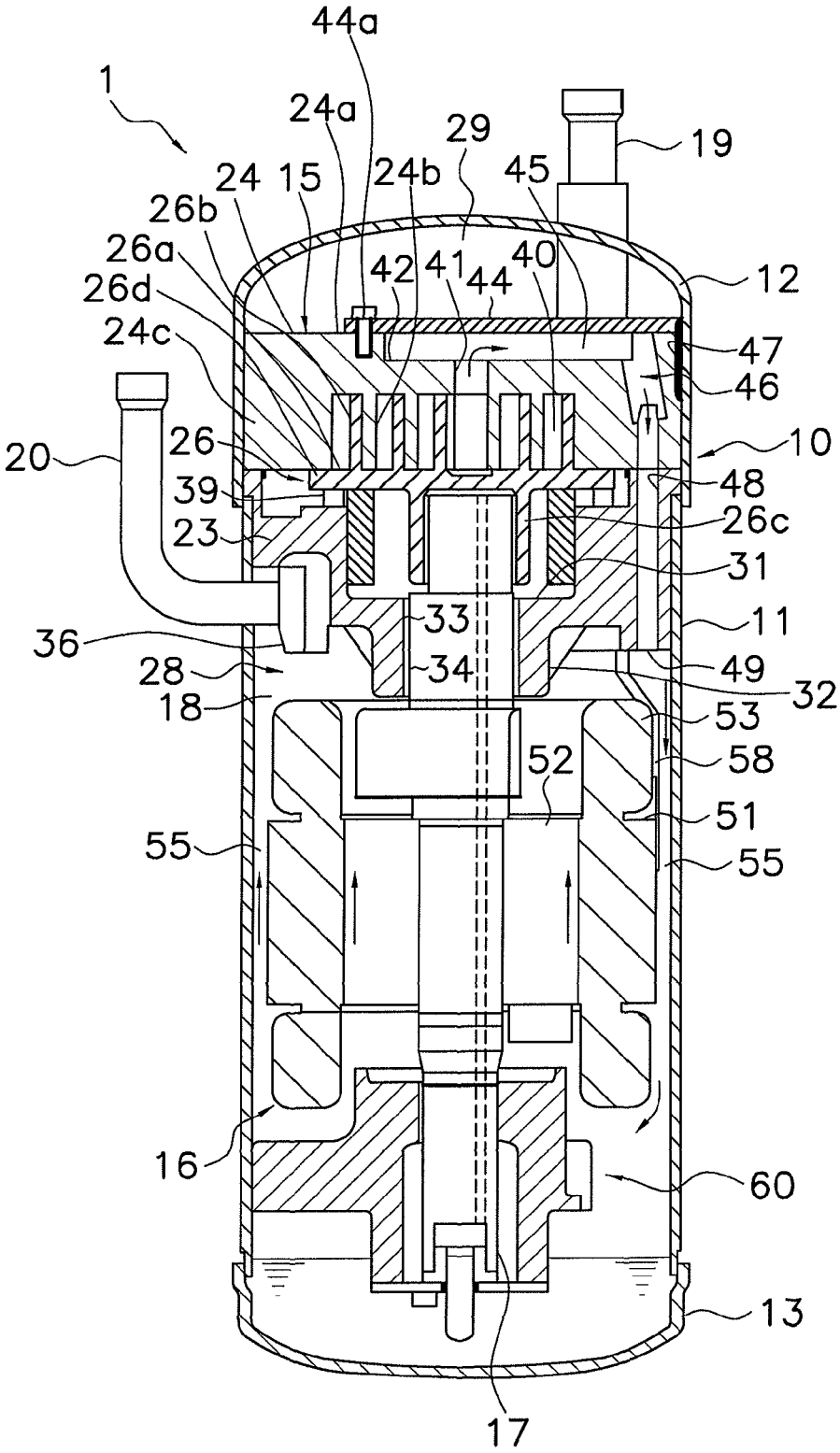
FIG. 1 is a longitudinal sectional view of a high-low pressure dome-type compressor according to the first embodiment.

The high-low pressure dome-type compressor 1 according to the first embodiment constitutes a refrigerant circuit together with an evaporator, a condenser, an expansion mechanism, and the like; acts to compress a gas refrigerant in the refrigerant circuit; and is primarily composed of a hermetically sealed oblong cylindrical dome-type casing 10, a scroll compression mechanism 15, an Oldham ring 39, a drive motor 16, a lower main bearing 60, a suction tube 19, and a discharge tube 20, as shown in FIG. 1. The constituent elements of the high-low pressure dome-type scroll compressor 1 will be described in detail below.

<Details of Constituent Elements of High-low Pressure Dome-type Compressor>

(1) Casing

The casing 10 has a substantially cylindrical trunk casing 11, a bowl-shaped upper wall portion 12 welded in an airtight manner to an upper end of the trunk casing 11, and a bowl-shaped bottom wall 13 welded in airtight manner to the lower end of the trunk casing 11. Primarily accommodated in the casing 10 are the scroll compression mechanism 15 for compressing a gas refrigerant, and the drive motor 16 disposed below the scroll compression mechanism 15. The scroll compression mechanism 15 and the drive motor 16 are connected by a drive shaft 17 disposed so as to extend in the vertical direction inside the casing 10. As a result, a clearance space 18 is formed between the scroll compression mechanism 15 and the drive motor 16.

(2) Scroll Compression Mechanism

The scroll compression mechanism 15 is primarily composed of a housing 23, a fixed scroll 24 provided in close contact above the housing 23, and a movable scroll 26 for meshing with the fixed scroll 24, as shown in FIG. 1. The constituent elements of the scroll compression mechanism 15 will be described in detail below.

a) Housing

The housing 23 is configured primarily from a plate part 23*a*, and a first external peripheral wall 23*b* formed upright on the external peripheral surface of the plate part. The housing 23 is secured along the external peripheral surface by being press fitted to the trunk casing 11 across the entire circumference. In other words, the trunk casing 11 and the housing 23 are joined in airtight manner along their entire peripheries. For this reason, the interior of the casing 10 is partitioned into a high-pressure space 28 below the housing 23 and a low-pressure space 29 above the housing 23. Also formed in the housing 23 are a housing concavity 31 formed as a notch in the center of the upper surface, and a bearing portion 32 that extends downward from the center of the lower surface. A bearing hole 33 that passes through in the vertical direction is formed in the bearing portion 32, and the drive shaft 17 is rotatably fitted to the bearing hole 33 via a bearing 34.

b) Fixed Scroll

Figure 2:
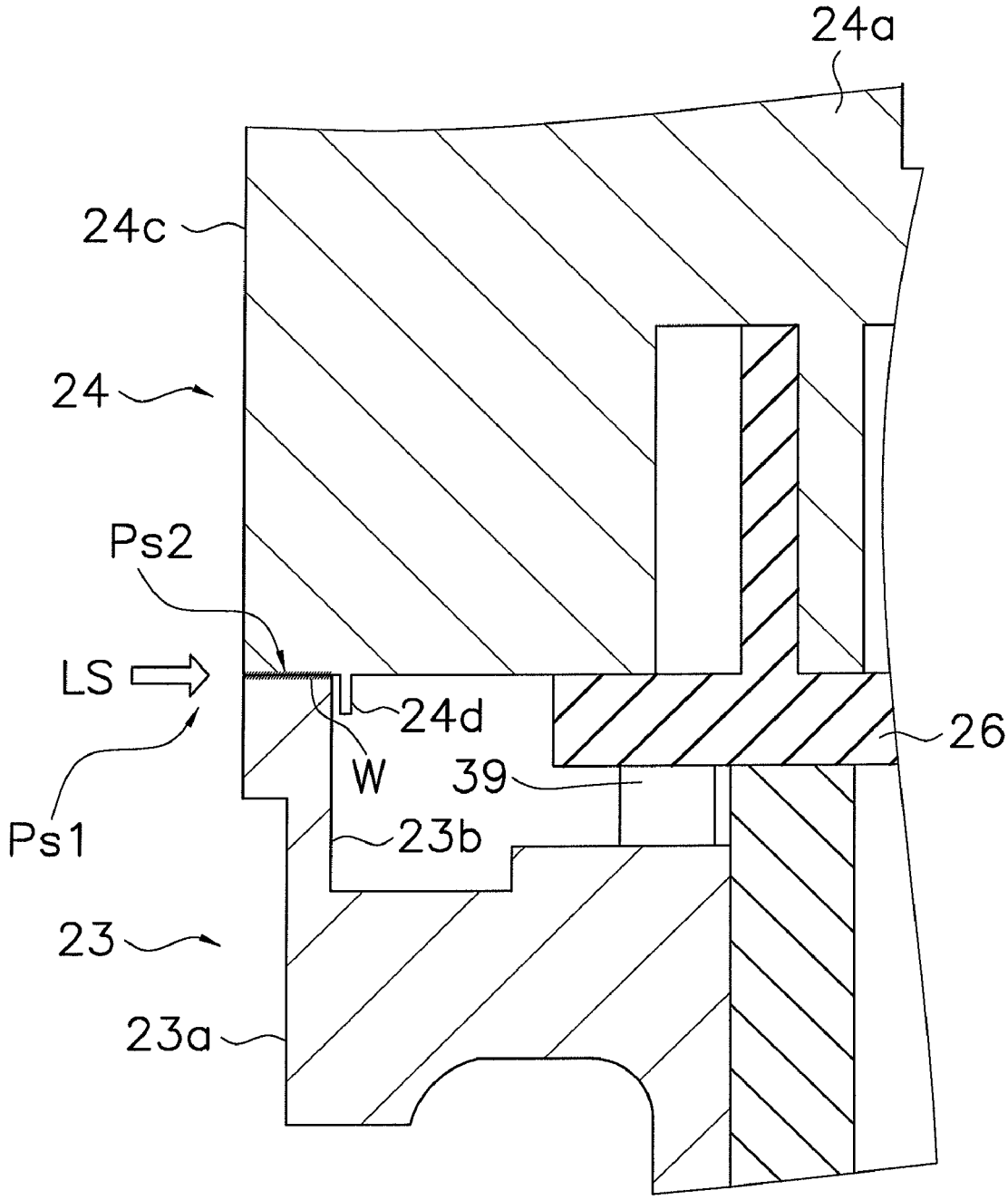
FIG. 2 is an enlarged view of the location where the housing and the fixed scroll are joined in a high-low pressure dome-type compressor according to the first embodiment.

The fixed scroll 24 is configured primarily from an end plate 24*a*, a scroll (involute shape) wrap 24*b* formed on the lower surface of the end plate 24*a*, and a second external peripheral wall 24*c* enclosing the wrap 24*b*. A discharge passage 41 that is in communication with a later-described compression chamber 40, and an enlarged concave portion 42 that is in communication with the discharge passage 41, are formed in the end plate 24*a*. The discharge passage 41 is formed so as to extend in the vertical direction in the center portion of the end plate 24*a*. The enlarged concave portion 42 is configured from a concavity that is formed as a notch in the upper surface of the end plate 24*a* and that widens horizontally. A lid body 44 is fastened and fixed in place by a bolt 44*a* on the upper surface of the fixed scroll 24 so as to close off the enlarged concave portion 42. The lid body 44 covers the enlarged concave portion 42, thereby forming a muffler space 45 composed of an expansion chamber for muffling the operating sounds of the scroll compression mechanism 15. The fixed scroll 24 and the lid body 44 are sealed by being firmly joined together via packing (not shown). A droplet guard wall 24*d* is provided in the lower end surface of the second external peripheral wall 24*c*, namely, in the inner peripheral side of the portion corresponding to the fastened surface (hereinafter referred to as second fastened surface) Ps2. The role of this droplet guard wall 24*d* will be described hereinunder (see FIG. 2).

c) Movable Scroll

The movable scroll 26 is primarily composed of an end plate 26*a*, a scroll (involute shape) wrap 26*b* formed on the upper surface of the end plate 26*a*, a bearing portion 26*c* formed on the lower surface of the end plate 26*a*, and a groove portion 26*d* formed in the two ends of the end plate 26*a*. The movable scroll 26 is supported on the housing 23 by fitting the Oldham ring 39 into the groove portion 26*d*. The upper end of the drive shaft 17 is fitted into the bearing portion 26*c*. The movable scroll 26, by being incorporated into the scroll compression mechanism 15 in this manner, non-rotatably orbits the interior of the housing 23 due to the rotation of the drive shaft 17. The wrap 26*b* of the movable scroll 26 meshes with the wrap 24*b* of the fixed scroll 24, and the compression chamber 40 is formed between the contact portions of the two wraps 24*b*, 26*b*. In the compression chamber 40, the capacity between the wraps 24*b*, 26*b* shrinks towards the center as the movable scroll 26 revolves. A gas refrigerant is compressed in this manner in the high-low pressure dome-type compressor 1 of the first embodiment.

d) Other

A communication channel 46 is formed in the scroll compression mechanism 15 across the fixed scroll 24 and the housing 23. The communication channel 46 is formed so that a scroll-side channel 47 formed as a notch in the fixed scroll 24 communicates with a housing-side channel 48 formed as a notch in the housing 23. The upper end of the communication channel 46, i.e., the upper end of the scroll-side channel 47, opens to the enlarged concave portion 42, and the lower end of the communication channel 46, i.e., the lower end of the housing-side channel 48, opens to the lower end surface of the housing 23. In other words, a discharge port 49 for allowing the refrigerant in the communication channel 46 to flow out to the clearance space 18 is configured by the lower end opening of the housing-side channel 48.

(3) Oldham Ring

The Oldham ring 39 is a member for preventing the movable scroll 26 from rotatably moving as described above, and is fitted into Oldham grooves (not shown) formed in the housing 23. These Oldham grooves have an elliptical shape and are disposed at positions facing each other in the housing 23.

(4) Drive Motor

The drive motor 16 is a DC motor in the first embodiment, and is primarily composed of an annular stator 51 secured to the inner wall surface of the casing 10, and a rotor 52 rotatably accommodated with a small gap (air gap channel) inside the stator 51. The drive motor 16 is disposed so that the upper end of a coil end 53 formed at the top side of the stator 51 is at substantially the same height position as the lower end of the bearing portion 32 of the housing 23.

A copper wire is wound around a tooth portion of the stator 51, and a coil end 53 is formed above and below the stator. The external peripheral surface of the stator 51 is provided with core cut portions that have been formed as notches in a plurality of locations from the upper end surface to the lower end surface of the stator 51 at prescribed intervals in the peripheral direction. A motor cooling channel 55 that extends in the vertical direction is formed by the core cut portions between the trunk casing 11 and the stator 51.

The rotor 52 is drivably connected to the movable scroll 26 of the scroll compression mechanism 15 via the drive shaft 17 disposed in the axial center of the trunk casing 11 so as to extend in the vertical direction. A guide plate 58 for guiding the refrigerant that has flowed out of the discharge port 49 of the communication channel 46 to the motor cooling channel 55 is disposed in the clearance space 18.

(5) Lower Main Bearing

The lower main bearing 60 is placed in a lower space below the drive motor 16. The lower main bearing 60 is secured to the trunk casing 11, constitutes the lower end-side bearing of the drive shaft 17, and supports the drive shaft 17.

(6) Suction Tube

The suction tube 19 is used for guiding the refrigerant of the refrigerant circuit to the scroll compression mechanism 15 and is fitted in an airtight manner in the upper wall portion 12 of the casing 10. The suction tube 19 passes through the low-pressure space 29 in the vertical direction, and the inside end portion is fitted into the fixed scroll 24.

(7) Discharge Tube

The discharge tube 20 is used for discharging the refrigerant inside the casing 10 to the exterior of the casing 10, and is fitted in an airtight manner into the trunk casing 11 of the casing 10. The discharge tube 20 has an inside end portion 36 formed in the shape of a cylinder extending in the vertical direction, and is secured to the lower end portion of the housing 23. The inside end opening of the discharge tube 20, i.e., the inlet, is opened downward.

<Method for Manufacturing Housing and Fixed Scroll>

In the first embodiment, the housing 23 and the fixed scroll 24 are manufactured by the following manufacturing method.

(1) Raw Material

In the first embodiment, a billet to which have been added C: 2.3 to 2.4 wt %, Si: 1.95 to 2.05 wt %, Mn: 0.6 to 0.7 wt %, P: <0.035 wt %, S: <0.04 wt %, Cr: 0.00 to 0.50 wt %, and Ni: 0.50 to 1.00 wt % is used as the iron material, that is, a raw material, of the constituent elements described above. As used herein, weight ratios are ratios in relation to the entire amount. Also, the term "billet" refers to a pre-molded material in which an iron material having the above-described components has been temporarily melted in a melting furnace and thereafter molded into a cylindrical shape or the like using a continuous casting apparatus. Here, the content of C and Si is determined so as to satisfy two objects: to achieve a tensile strength and tensile modulus of elasticity that are greater than those of flake graphite cast iron, and to provide a suitable fluidity for molding a constituent element preform (object to be made into the final constituent element) having a complex shape. The Ni content is determined so as to achieve a metal structure that improves the toughness of the metal structure and is suitable for preventing surface cracks during molding.

(2) Manufacturing Steps

The constituent elements described above are manufactured via a semi-molten die casting step, a heat treatment step, and a final finishing step. These steps are described in detail hereinbelow.

a) Semi-molten Die Casting Step

In the semi-molten die casting step, first, a billet is brought to a semi-molten state by high-frequency heating. Next, the semi-molten billet is introduced into a prescribed metal mold, and is then molded into a desired shape while a prescribed pressure is applied using a die casting machine to obtain a constituent element preform. The metal structure of the constituent element preform becomes white iron overall when the constituent element preform is removed from the mold and rapidly cooled. The constituent element preform is slightly larger than the constituent element that will be ultimately obtained, and the constituent element preform becomes the final constituent element when the machining allowance has been removed in a later final finishing step.

b) Heat Treatment Step

In the heat treatment step, the constituent element preform after the semi-molten die casting step is heat treated. In this heat treatment step, the metal structure of the constituent element preform changes from a white iron structure to a metal structure composed of a pearlite/ferrite base and granular graphite. The graphitization and pearlite transformation of the white iron structure can be adjusted by adjusting the heat treatment temperature, the holding time, the cooling rate, and the like. As described, e.g., in "Research of Semi-Molten Iron Molding Techniques," Honda R&D Technical Review, Vol. 14, No. 1, a metal structure having a tensile strength of about 500 MPa to 700 MPa and a hardness of about HB 150 (HRB 81 (converted value from the SAE J 417 hardness conversion table)) to HB 200 (HRB 96 (converted value from the SAE J 417 hardness conversion table)) can be obtained by holding the metal for 60 minutes at 950° C., and thereafter gradually cooling the metal in a furnace at a cooling rate of 0.05 to 0.10° C./sec. Such a metal structure is primarily ferrite, and is therefore soft and has excellent machinability. However, a built-up edge of a blade during machining may be formed, and the service life of the blade tool may be reduced. The metal is held for 60 minutes at 1000° C., then air cooled, held for a prescribed length of time at a temperature that is slightly lower than the initial temperature, and thereafter air cooled, whereby a metal structure having a tensile strength of about 600 MPa to 900 MPa and a hardness of about HB 200 (HRB 96 (converted value from the SAE J 417 hardness conversion table)) to HB 250 (HRB 105, HRC 26 (converted value from the SAE J 417 hardness conversion table; HRB 105 is a reference value for extending beyond the effective practical range of a test type)) can be obtained. In such a metal structure, a substance whose hardness is equal to that of flake graphaite cast iron has the same machinability as flake graphaite cast iron, and better machinability than spheroidal graphite cast iron having the same ductility and toughness. Also possible is a method in which the metal is held for 60 minutes at 1000° C., cooled in oil, held for a prescribed length of time at a temperature that is slightly lower than the initial temperature, and thereafter air cooled, whereby a metal structure having a tensile strength of about 800 MPa to 1300 MPa and a hardness of about HB 250 (HRB 105, HRC 26 (converted value from the SAE J 417 hardness conversion table; HRB 105 is a reference value for extending beyond the effective practical range of a test type)) to HB 350 (HRB 122, HRC 41 (converted value from the SAE J 417 hardness conversion table; HRB 122 is a reference value for extending beyond the effective practical range of a test type)) can be obtained. Such a metal structure is primarily pearlite, and is therefore hard and has poor machinability but possesses excellent abrasion resistance. However, there is a possibility that the metal will damage the other member of the sliding pair due to excessive hardness.

In the heat treatment step in the first embodiment, the slider preform is heat treated under conditions that cause the hardness to be greater than HRB 90 (HB 176 (converted value from the SAE J 417 hardness conversion table) but less than HRB 100 (HB 219 (converted value from the SAE J 417 hardness conversion table). It is apparent that when the slider preform is manufactured using semi-molten die casting, the hardness of the slider preform is in a proportional relationship with the tensile strength of the slider preform, and therefore substantially corresponds to a range in which the tensile strength of the slider preform in this case is from 600 MPa to 900 MPa.

c) Final Finishing Step

Figure 3:
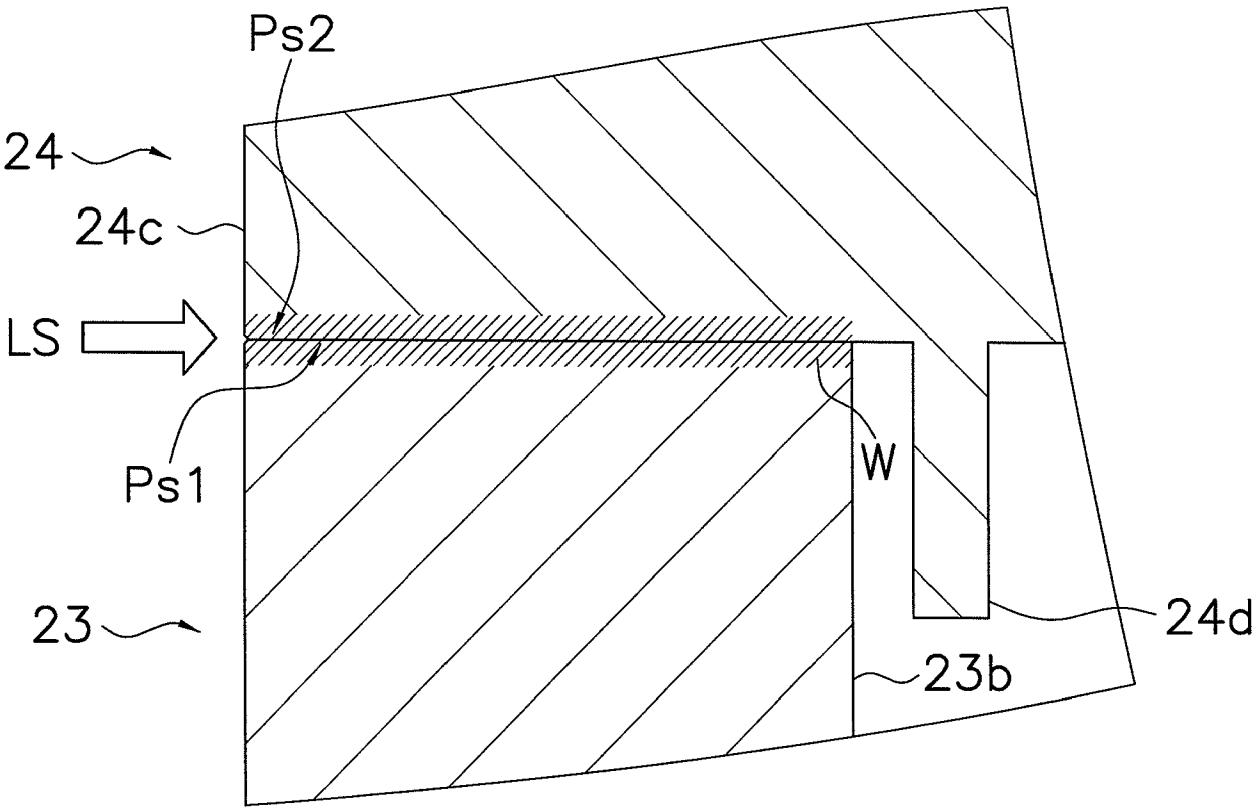
FIG. 3 is an enlarged view of the location where the housing and the fixed scroll are joined in a high-low pressure dome-type compressor according to the first embodiment.

In the final finishing step, the constituent element preform is machined to and the constituent element is completed. In the first embodiment, the standard value of the surface roughness (Ra) along a center line through the lower end surface Ps2 (see FIGS. 2 and 3) of the fixed scroll 24 is 0.6 to 1.2 μm, and the standard value of the flatness of this surface is 0.01 to 0.03 mm. The standard value of the surface roughness (Ra) along the center line through the upper end surface Ps1 (see FIGS. 2 and 3) of the housing 23 is 0.6 to 1.2 μm, and the standard value of the flatness of this surface is 0.01 to 0.03 mm. Furthermore, 0.07 mm of chamfering is performed on the outside ends of the lower end surface Ps2 of the fixed scroll 24 and on the outside ends of the upper end surface Ps1 of the housing 23 (see FIG. 3).

<Method for Joining Housing and Fixed Scroll>

In the first embodiment, the housing 23 and the fixed scroll 24 are fastened together not by bolts but by laser welding. Specifically, after the crankshaft 17, the movable scroll 26, the Oldham ring 39, and other components are incorporated in the housing 23, the upper end surface Ps1 of the housing 23 and the lower end surface Ps2 of the fixed scroll 24 are placed together and pushed on from both sides. In this state, fiber laser light LS having a spot diameter of 0.3 mm is directed so as to envelop the contact surface. At this time, the position irradiated by the fiber laser light LS is adjusted using a line along the top side of the chamfered surface of the fixed scroll 24 or the bottom side of the chamfered surface of the housing 23 as a reference line, while viewing along the direction in which the laser light is directed. The fiber laser light LS is adjusted in terms of output and welding rate so that the amount of heat input per unit length in the direction of welding propagation is 50±5 (J/mm). In the first embodiment, the contact surface is laser welded along the entire periphery. The contact surface is also laser welded from the external periphery through to the internal periphery in the first embodiment. In other words, the entire contact surface is laser welded. In the first embodiment, since the fixed scroll 24 is provided with the droplet guard wall 24*d*, droplets can be prevented from being deposited on the movable scroll 26, the Oldham ring 39, the thrust surface of the fixed scroll 24, and other components during laser welding.

<Operation of High-low Pressure Dome-type Compressor>

When the drive motor 16 is driven, the drive shaft 17 rotates and the movable scroll orbits without rotation. At this point, the low-pressure gas refrigerant passes through the suction tube 19, is suctioned from the peripheral edge of the compression chamber 40 into the compression chamber 40, is compressed as the capacity of the compression chamber 40 changes, and becomes a high-pressure gas refrigerant. The high-pressure gas refrigerant passes from the center of the compression chamber 40 through the discharge passage 41; is discharged to the muffler space 45; then passes through the communication channel 46, the scroll-side channel 47, the housing-side channel 48, and the discharge port 49; flows out to the clearance space 18; and flows downward between the guide plate 58 and the inner surface of the trunk casing 11. A portion of the gas refrigerant branches off and flows in the peripheral direction between the guide plate 58 and the drive motor 16 when the gas refrigerant flows downward between the guide plate 58 and the inner surface of the trunk casing 11. At this point, lubricating oil mixed with the gas refrigerant separates off. On the other hand, the other portion of the branched gas refrigerant flows downward through the motor cooling channel 55 to the space below the motor, and then reverses course and flows upward through the motor cooling channel 55 on the side (left side in FIG. 1) facing the communication channel 46 or the air gap channel between the stator 51 and the rotor 52. Thereafter, the gas refrigerant that has passed through the guide plate 58 and the gas refrigerant that has flowed from the air gap channel or the motor cooling channel 55 merge at the clearance space 18. The merged gas refrigerant flows from the inside-end portion 36 of the discharge tube 20 to the discharge tube 20, and is then discharged to the exterior of the casing 10. The gas refrigerant discharged to the exterior of the casing 10 circulates through the refrigerant circuit, then passes through the suction tube 19 again, and is suctioned and compressed in the scroll compression mechanism 15.

<Characteristics of High-low Pressure Dome-type Compressor>

(1)

In the high-low pressure dome-type compressor 1 according to the first embodiment, the fixed scroll 24 manufactured by semi-molten die casting and containing 2.3 to 2.4 wt % of carbon is fastened to the housing 23 not by a bolt but by laser welding. Therefore, the high-low pressure dome-type compressor 1 is capable of being reduced in size (reduced in diameter) and does not lose conventional slideability or machinability.

(2)

In the high-low pressure dome-type compressor 1 according to the first embodiment, the fixed scroll 24 is formed by semi-molten die casting, and the tensile strength thereof is adjusted by heat treatment to from 600 MPa or greater to 900 MPa or less. Therefore, the high-low pressure dome-type compressor 1 exhibits high durability and has superior toughness in comparison with FC. The compressor is therefore not readily damaged by sudden increases in internal pressure or by the inclusion of foreign matter. Even if damage were to occur, small scrapings are not likely to be produced and pipes do not need to be cleaned.

(3)

In the high-low pressure dome-type compressor 1 according to the first embodiment, when the housing 23 and the fixed scroll 24 are laser welded, the fiber laser light LS is adjusted in terms of output and welding rate so that the amount of heat input per unit length in the direction of welding propagation is 50±5 (J/mm). Therefore, in this high-low pressure dome-type compressor 1, the tensile strength of the laser-welded portion W can be maintained at 80% or greater, and a ratio of fatigue limit to cast iron strength of 0.4 to 0.5 can be obtained in a plane bending test.

(4)

In the high-low pressure dome-type compressor 1 according to the first embodiment, fiber laser light LS is used when the housing 23 and the fixed scroll 24 are laser welded. Therefore, in this high-low pressure dome-type compressor 1, low-input thermal joining is possible because deep penetration is achieved during laser welding.

(5)

In the high-low pressure dome-type compressor 1 according to the first embodiment, fiber laser light LS having a spot diameter of 0.3 mm is used in laser welding. Therefore, in this high-low pressure dome-type compressor 1, penetration defects resulting from welding position deviations can be prevented.

(6)

In the high-low pressure dome-type compressor 1 according to the first embodiment, the standard value of the surface roughness (Ra) along a center line through the lower end surface Ps2 of the fixed scroll 24 and the upper end surface Ps1 of the housing 23 is 0.6 to 1.2 μm, and the standard value of its flatness is 0.01 to 0.03 mm. Therefore, in this high-low pressure dome-type compressor 1, welding defects can be prevented while maintaining performance, reliability, and other such characteristics.

(7)

In the high-low pressure dome-type compressor 1 according to the first embodiment, substantially all of the contact portion between the first joining surface Ps1 and the second joining surface Ps2 is laser welded. Therefore, in this high-low pressure dome-type compressor 1, a seal more reliable than bolting is possible, an improvement in performance can be expected, and the start point of fatigue failure can be prevented. Therefore, this high-low pressure dome-type compressor 1 is capable of compressing carbon dioxide or another such high-pressure refrigerant.

(8)

In the high-low pressure dome-type compressor 1 according to the first embodiment, a filler material is not used in laser welding. Therefore, this high-low pressure dome-type compressor 1 can be made commercially available at a low price.

(9)

In the high-low pressure dome-type compressor 1 according to the first embodiment, the position irradiated by the fiber laser light LS is adjusted using for a reference the line of the top side of the chamfered surface of the fixed scroll 24 or the bottom side of the chamfered surface of the housing 23, as seen along the direction in which the laser light is directed. This chamfer is ¼ or less of the spot diameter of the fiber laser light. Therefore, in this high-low pressure dome-type compressor 1, positional deviations of laser light or positional deviations of the focal point can be prevented.

(10)

In the high-low pressure dome-type compressor 1 according to the first embodiment, the fixed scroll 24 is provided with a droplet guard wall 24*d*. Therefore, in this high-low pressure dome-type compressor 1, droplets can be prevented from being deposited on the movable scroll 26, the Oldham ring 39, the thrust surface of the fixed scroll 24, and other components during laser welding.

<Modified Examples of First Embodiment>

(A)

An airtight high-low pressure dome-type compressor 1 is adopted in the first embodiment, but the compressor may be a high-pressure dome-type compressor or a low-pressure dome-type compressor. The compressor may also be a semi-airtight or open compressor.

(B)

In the high-low pressure dome-type compressor 1 according to the first embodiment, an Oldham ring 39 is used as the rotation-preventing mechanism, but a pin, a ball coupling, a crank, or the like may also be used as the rotation-preventing mechanism.

(C)

In the first embodiment, an example is given of the case in which the compressor 1 is used in a refrigerant circuit, but the application is not limited to air conditioning, and can also be made to a compressor, a blower, a supercharger, a pump, or the like, used alone or incorporated into a system.

(D)

A lubricating oil is present in the high-low pressure dome-type compressor 1 according to the first embodiment, but an oil-less or oil-free (which may or may not use oil) compressor, blower, supercharger, or pump may also be used.

(E)

In the high-low pressure dome-type compressor 1 according to the first embodiment, the housing 23 and the fixed scroll 24 are formed by semi-molten die casting and contain 2.3 to 2.4 wt % of carbon, but the carbon content can also be 2.0 wt % or greater and 2.7 wt % or less.

(F)

In the high-low pressure dome-type compressor 1 according to the first embodiment, the housing 23 and the fixed scroll 24 are formed by semi-molten die casting, but the housing 23 and the fixed scroll 24 may also be formed by semi-solid die casting.

(G)

Fiber laser light LS having a spot diameter of 0.3 mm is used in the laser welding according to the first embodiment, but the spot diameter can also be 0.2 mm or greater and 0.7 mm or less.

(H)

Fiber laser light is used in the laser welding according to the first embodiment, but another type of laser light may also be used.

(I)

In the high-low pressure dome-type compressor 1 according to the first embodiment, the standard value of the surface roughness (Ra) along a center line through the lower end surface Ps2 of the fixed scroll 24 and the upper end surface Ps1 of the housing 23 before laser welding is 0.6 to 1.2 μm, but the standard value of the surface roughness (Ra) along the center line can also be 1.2 μm or less.

(J)

In the high-low pressure dome-type compressor 1 according to the first embodiment, the standard value of the flatness of the lower end surface Ps2 of the fixed scroll 24 and the upper end surface Ps1 of the housing 23 before laser welding is 0.01 to 0.03 mm, but the standard value of the flatness can also be 0.03 mm or less.

(K)

In the first embodiment, in the high-low pressure dome-type compressor 1, the housing 23 and the fixed scroll 24 are formed by semi-molten die casting using a billet having a carbon content of 2.3 to 2.4 wt %, but the cylinder, the front head, the rear head, the middle plate, and other components of a swing compressor or a rotary compressor may be similarly formed by semi-molten die casting using a billet having a carbon content of 2.3 to 2.4 wt %, and may be laser welded to in the same procedure as the first embodiment.

(L)

During the laser welding according to the first embodiment, the fiber laser light LS is adjusted in terms of output and welding rate so that the amount of heat input per unit length in the direction of welding propagation is 50±5 (J/mm), but the amount of heat input can also be 10 (J/mm) or greater and 70 (J/mm) or less.

(M)

In the high-low pressure dome-type compressor 1 according to the first embodiment, substantially all of the contact portion between the first joined surface Ps1 and the second joined surface Ps2 is laser welded. However, it is sufficient to laser weld 50% or more of the contact portion between the first joined surface Ps1 and the second joined surface Ps2.

(N)

Figure 4:
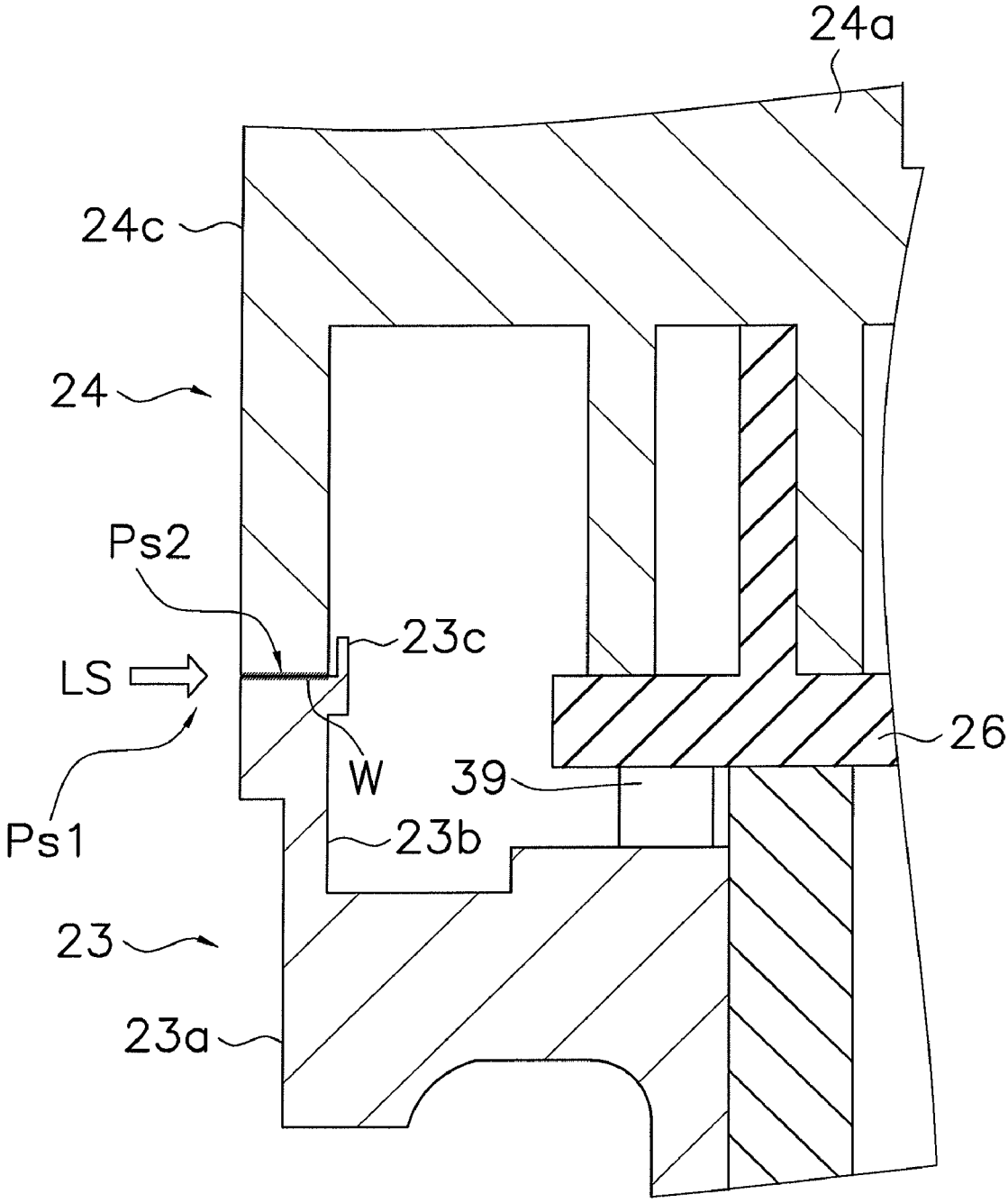
FIG. 4 is an enlarged view of the location where the housing and the fixed scroll are joined in a high-low pressure dome-type compressor according to a modified example (N) of the first embodiment.

In the high-low pressure dome-type compressor 1 according to the first embodiment, the fixed scroll 24 is provided with a droplet guard wall 24*d*, but a droplet guard wall 23*c* may also be provided to the housing 23 as shown in FIG. 4.

(O)

In the high-low pressure dome-type compressor 1 according to the first embodiment, chamfers of 0.07 mm are performed on the outer ends of the lower end surface of the fixed scroll 24 and on the outer ends of the upper end surface Ps1 of the housing 23, but the size of the chamfers can also range from greater than 0 mm to ¼ or less of the spot diameter of the laser light.

Second Embodiment

Figure 5:
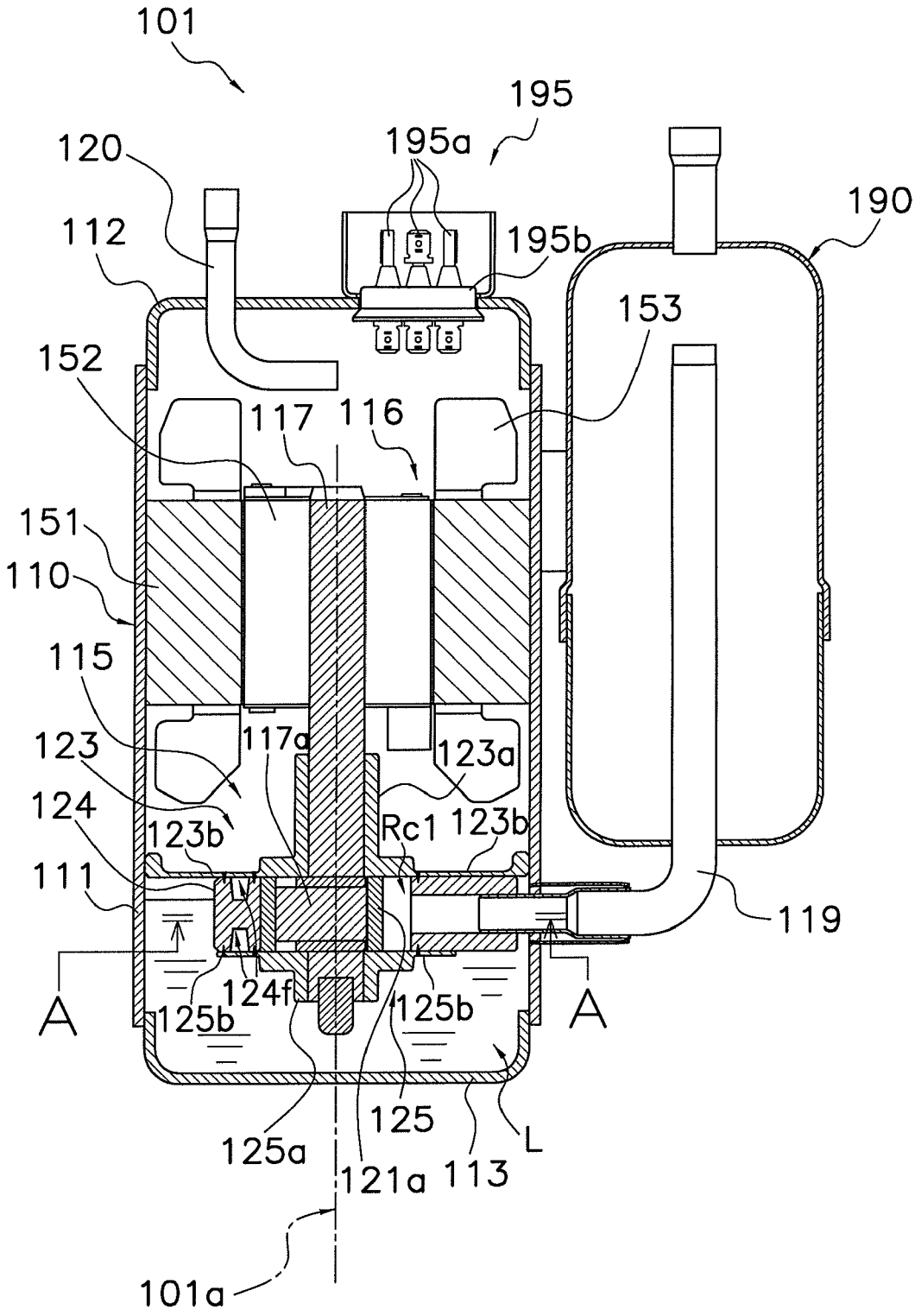
FIG. 5 is a longitudinal sectional view of a swing compressor according to the second embodiment.

A swing compressor 101 according to the second embodiment is configured primarily from a cylindrical sealed dome type casing 110, a swing compression mechanism 115, a drive motor 116, a suction tube 119, a discharge tube 120, and a terminal 195, as shown in FIG. 5. In this swing compressor 101, an accumulator (gas-liquid separator) 190 is attached to the casing 110. The constituent elements of the swing compressor 101 are described in detail hereinbelow.

<Details of Constituent Elements of Swing Compressor>

(1) Casing

The casing 110 has a substantially cylindrical trunk casing 111, a bowl-shaped upper wall portion 112 welded in an airtight manner to the upper end of the trunk casing 111, and a bowl-shaped bottom wall 113 welded in an airtight manner to the lower end of the trunk casing 111. This casing 110 primarily houses a swing compression mechanism 115 for compressing a gas refrigerant, and a drive motor 116 disposed above the swing compression mechanism 115. The swing compression mechanism 115 and the drive motor 116 are connected by a crankshaft 117 disposed so as to extend in the vertical direction inside the casing 110.

(2) Swing Compression Mechanism

Figure 7:
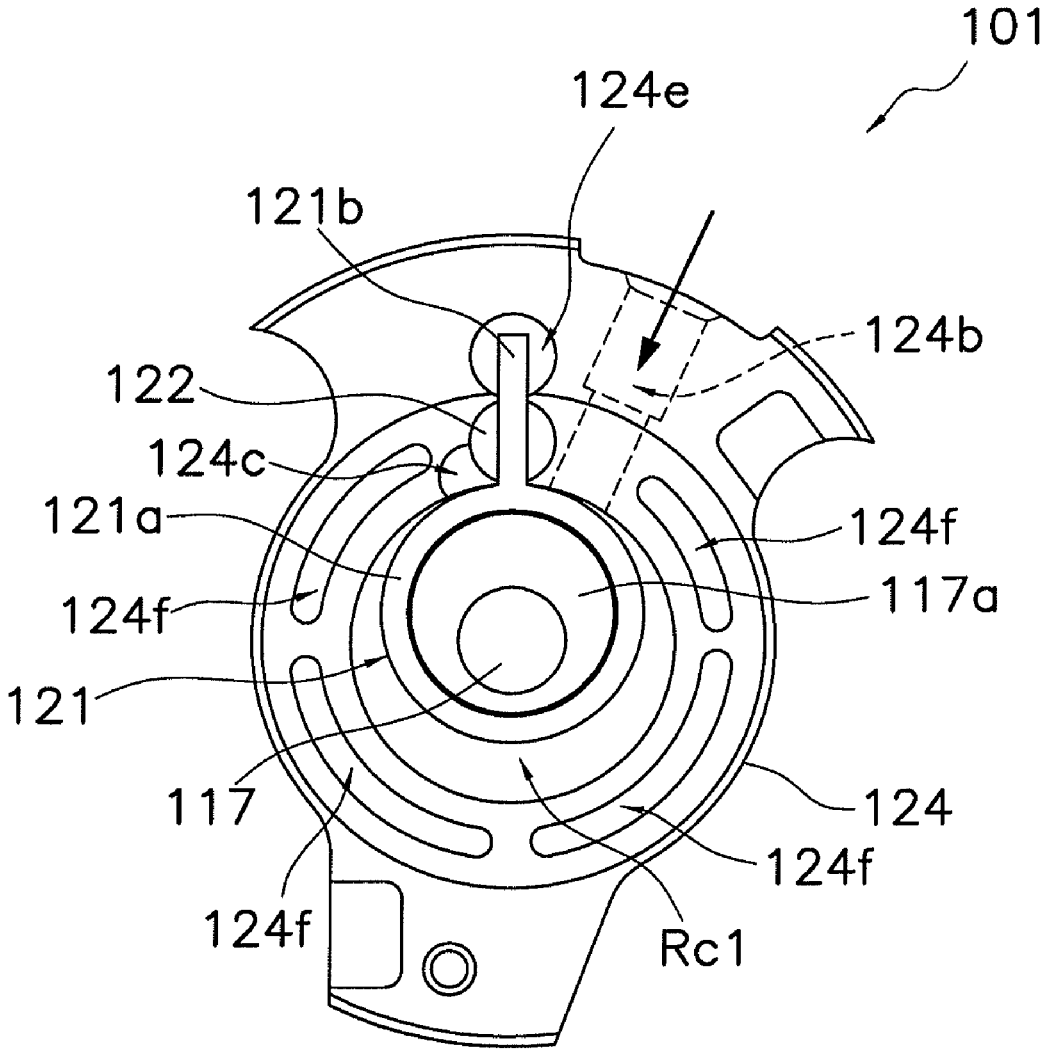
FIG. 7 is a cross-sectional view along the line A-A of a compressor mechanism constituting the swing compressor according to the second embodiment.

The swing compression mechanism 115 is configured primarily from the crankshaft 117, a piston 121, a bushing 122, a front head 123, a cylinder block 124, and a rear head 125, as shown in FIGS. 5 and 7. In the second embodiment, the front head 123 and the rear head 125 are integrally joined with the cylinder block 124 by performing penetration laser welding joining on parts 123*b*, 125*b* along the axial direction 101*a* of the crankshaft 117. In the second embodiment, the swing compression mechanism 115 is immersed in the lubricating oil L stored in the bottom of the casing 110, and the lubricating oil L is fed by differential pressure to the swing compression mechanism 115. The constituent elements of the swing compression mechanism 115 are described in detail hereinbelow.

a) Cylinder Block

Figure 6:
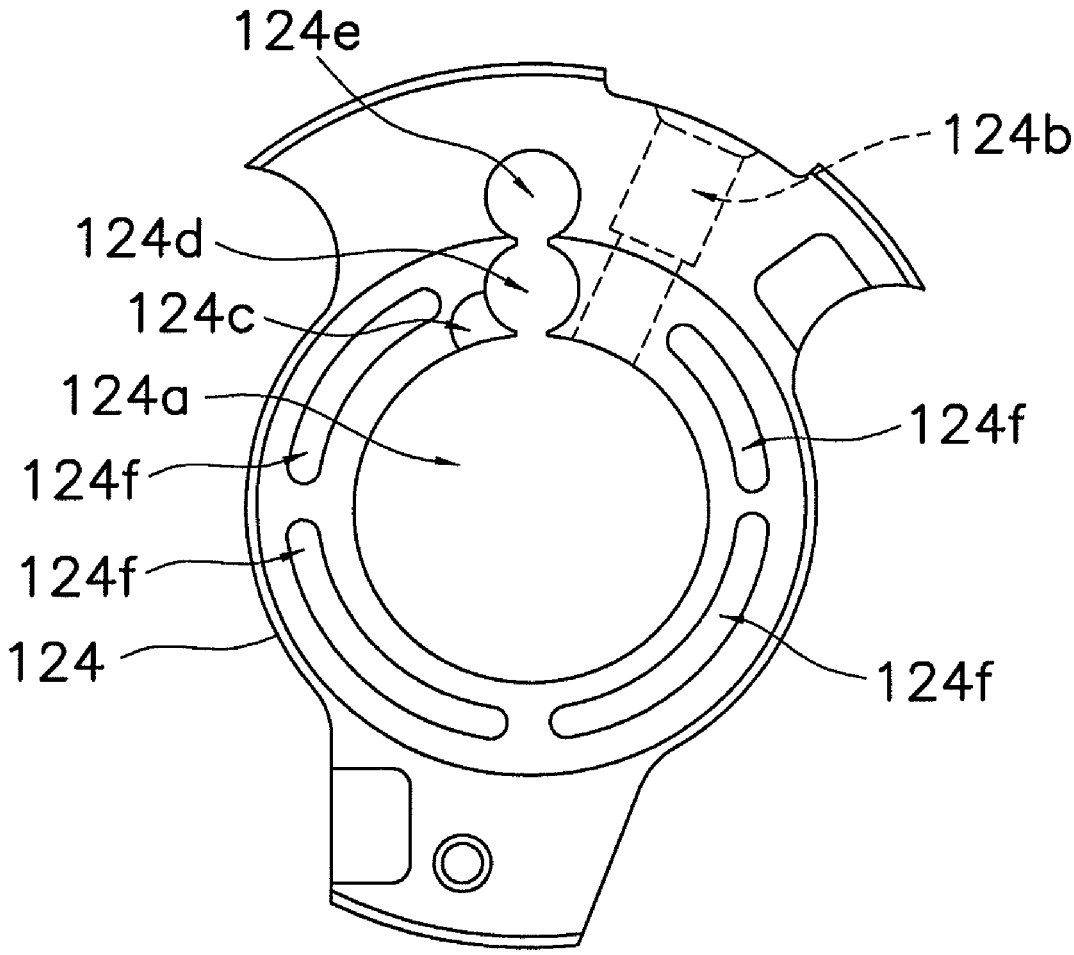
FIG. 6 is a top view of a cylinder block constituting a swing compressor according to the second embodiment.

A cylinder hole 124*a*, a suction hole 124*b*, a discharge channel 124*c*, a bushing accommodation hole 124*d*, a blade accommodation hole 124*e*, and thermal insulation grooves 124*f* are formed in the cylinder block 124 as shown in FIGS. 5 and 6. The cylinder hole 124*a* is a cylindrical hole that passes along the plate thickness direction, as shown in FIGS. 5 and 6. The suction hole 124*b* extends from the external peripheral wall surface through the cylinder hole 124*a*. The discharge channel 124*c* is formed by notching a portion of an internal peripheral part of the cylindrical portion that forms the cylinder hole 124*a*. The bushing accommodation hole 124*d* is a hole that passes through in the plate thickness direction and is disposed between the suction hole 124*b* and the discharge channel 124*c* when viewed in the plate thickness direction. The blade accommodation hole 124*e* is a hole that passes through in the plate thickness direction and is in communication with the bushing accommodation hole 124*d*. The thermal insulation grooves 124*f* are a plurality of grooves formed in both the top and bottom sides in the direction through the cylinder hole 124*a*, and the purpose of these grooves is to insulate the cylinder chamber Rc1.

The cylinder block 124 is fitted into the front head 123 and the rear head 125 so that the discharge channel 124*c* faces the front head 123 in a state in which an eccentric shaft portion 117*a* of the crankshaft 117 and a roller portion 121*a* of the piston 121 are accommodated in the cylinder hole 124*a*, a blade portion 121*b* of the piston 121 and the bushing 122 are accommodated in the bushing accommodation hole 124*d*, and the blade portion 121*b* of the piston 121 is accommodated in the blade accommodation hole 124*e* (see FIG. 7). As a result, the cylinder chamber Rc1 is formed on the swing compression mechanism 115; and the cylinder chamber Rc1 is partitioned by the piston 121 into a suction chamber that is in communication with the suction hole 124*b*, and a discharge chamber that is in communication with the discharge channel 124*c*. In this state, the roller portion 121*a* fits into the eccentric shaft portion 117*a*. No components are accommodated in the thermal insulation grooves 124*f*. The thermal insulation grooves 124*f* are preferably as close to a vacuum as possible.

b) Crankshaft

The crankshaft 117 has the eccentric shaft portion 117*a* at one end. The crankshaft 117 is secured to a rotor 152 of the drive motor 116 on the side not provided with the eccentric shaft portion 117*a*.

c) Piston

The piston 121 has a substantially cylindrical roller portion 121*a* and a blade portion 121*b* that protrudes outward in the radial direction of the roller portion 121*a*. The roller portion 121*a* is fitted into the eccentric shaft portion 117*a* of the crankshaft 117, and is inserted in this state into the cylinder hole 124*a* of the cylinder block 124. The roller portion 121*a* thereby moves in an orbiting fashion about the rotational axis of the crankshaft 117 when the crankshaft 117 rotates. The blade portion 121*b* is accommodated in the bushing accommodation hole 124*d* and the blade accommodation hole 124*e*. The blade portion 121*b* swings and simultaneously moves in a reciprocating fashion in the lengthwise direction.

d) Bushing

The bushings 122 are a substantially semicylindrical member, and are accommodated in the bushing accommodation hole 124*d* so as to hold the blade portion 121*b* of the piston 121.

e) Front Head

The front head 123 is a member that covers the cylinder block 124 on the side of the discharge channel 124*c* and is fitted into the casing 110. A bearing portion 123*a* is formed on the front head 123, and the crankshaft 117 is inserted into the bearing portion 123*a*. Also formed in the front head 123 is an opening (not shown) for feeding to the discharge tube 120 a refrigerant gas that flows in through the discharge channel 124*c* formed in the cylinder block 124. The opening can be opened and closed by a discharge valve (not shown) for preventing the backflow of refrigerant gas. The front head 123 is also provided with a joining part 123*b*. The joining part 123*b* is made thinner so as to be amenable to penetration laser welding, and the thickness thereof is 2 mm. In the second embodiment, the term "joining part 123*b*" specifically refers to an area in the front head 123 that corresponds to an area separated outward by 2 mm or more from the internal peripheral surface of the cylinder hole 124*a* of the cylinder block 124.

f) Rear Head

The rear head 125 covers the cylinder block 124 on the side opposite from the discharge channel 124*c*. A bearing portion 125*a* is formed on the rear head 125, and the crankshaft 117 is inserted into the bearing portion 125*a*. The rear head 125 is also provided with a joining part 125*b*. Similar to the bearing portion 123*a* of the front head 123, the joining part 125*b* is made thinner so as to be amenable to penetration laser welding, and the thickness thereof is 2 mm. In the second embodiment, the term "joining part 125*b*" specifically refers to an area in the rear head 125 that corresponds to an area separated outward by 2 mm or more from the internal peripheral surface of the cylinder hole 124*a* of the cylinder block 124.

(3) Drive Motor

The drive motor 116 is a DC motor in the second embodiment, and is primarily composed of an annular stator 151 secured to the internal wall surface of the casing 110, and a rotor 152 rotatably accommodated with a slight gap (air gap channel) on the inner peripheral surface of the stator 151.

Copper wire is wound about a tooth portion (not shown) of the stator 151, and a coil end 153 is formed above and below the stator. The external peripheral surface of the stator 151 is provided with core cut portions (not shown) that have been formed as a notch in a plurality of locations from the upper end surface to the lower end surface of the stator 151 at prescribed intervals in the peripheral direction.

The crankshaft 117 is secured along the rotational axis to the rotor 152.

(4) Suction Tube

The suction tube 119 is provided so as to pass through the casing 110, and has one end that is fitted into the suction hole 124*b* formed in the cylinder block 124, and another end that is fitted into the accumulator 190.

(5) Discharge Tube

The discharge tube 120 is provided so as to pass through the upper wall portion 112 of the casing 110.

(6) Terminal

The terminal 195 is configured primarily from terminal pins 195*a* and terminal bodies 195*b*, as shown in FIG. 5. The terminal pins 195*a* are supported by the terminal bodies 195*b*, and the terminal bodies 195*b* are fitted in and welded to the upper wall portion 112 of the casing 110. A lead wire (not shown) extending from the coil end 153 is connected to the sides of the terminal pins 195*a* inside the casing 110, and an external power source (not shown) is connected to the sides of the terminal pins 195*a* outside the casing 110.

<Method for Manufacturing Primary Components>

In the swing compressor 1 according to the second embodiment, the piston 121, the cylinder block 124, the front head 123, the rear head 125, and the crankshaft 117 are manufactured according to the following manufacturing method.

(1) Raw Material

The same iron materials as the first embodiment are used.

(2) Manufacturing Steps

The primarily components according to the second embodiment are manufactured in the same manner as the components according to the first embodiment. In a hardening step, a high-frequency heating device (not shown) is inserted into the bushing accommodation hole 124*d*, and the cylinder block 124 is subjected to a hardening treatment so that the hardness of the peripheral portion of the bushing accommodation hole 124*d* ranges from greater than HRC 50 to less than HRC 65.

<Assembling the Swing Compression Mechanism>

In the second embodiment, the swing compression mechanism 115 is manufactured via a clamping step and a penetration laser welding step.

Figure 8:
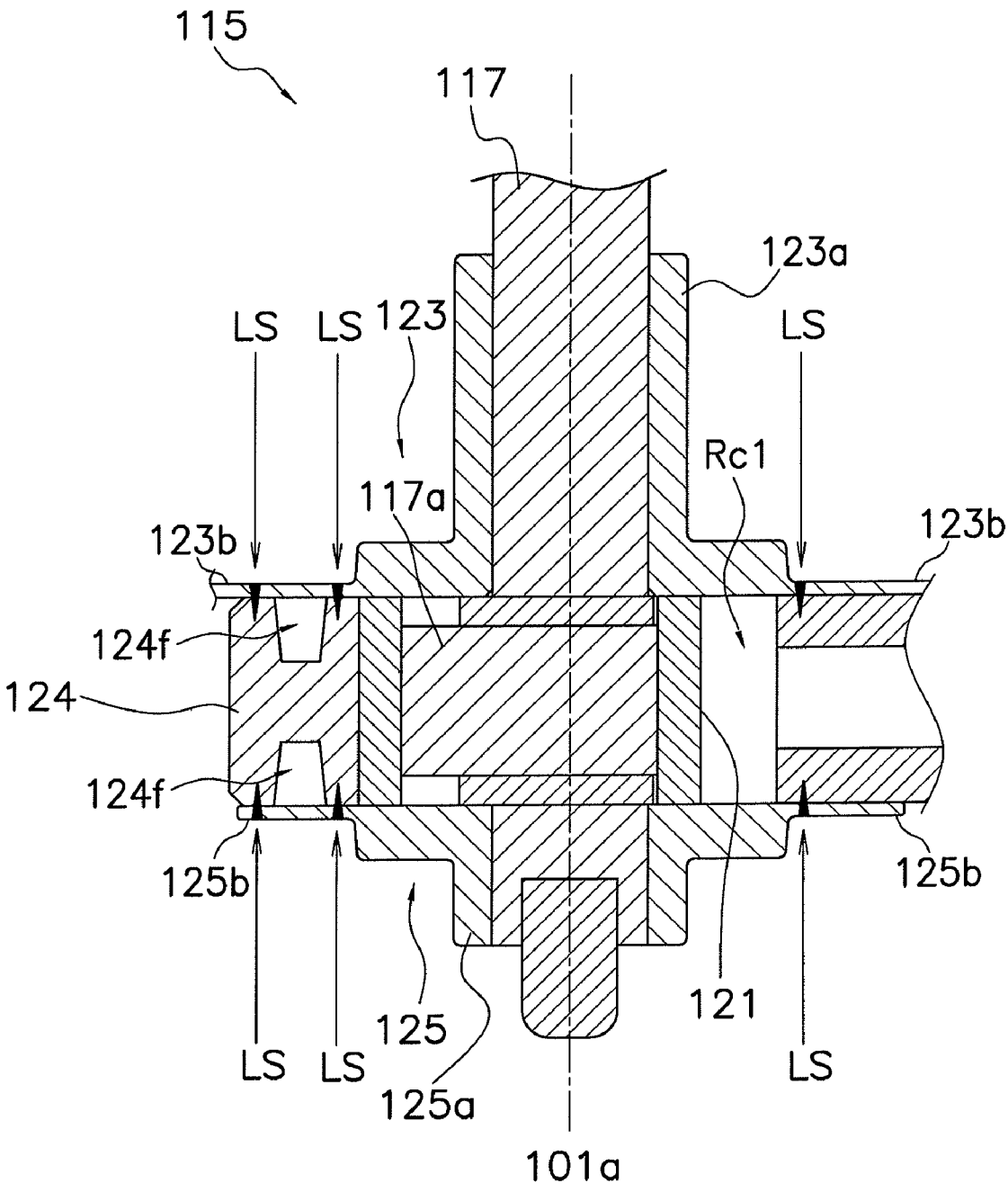
FIG. 8 is a drawing showing the direction of laser irradiation in penetration laser welding according to the second embodiment.
Figure 9:
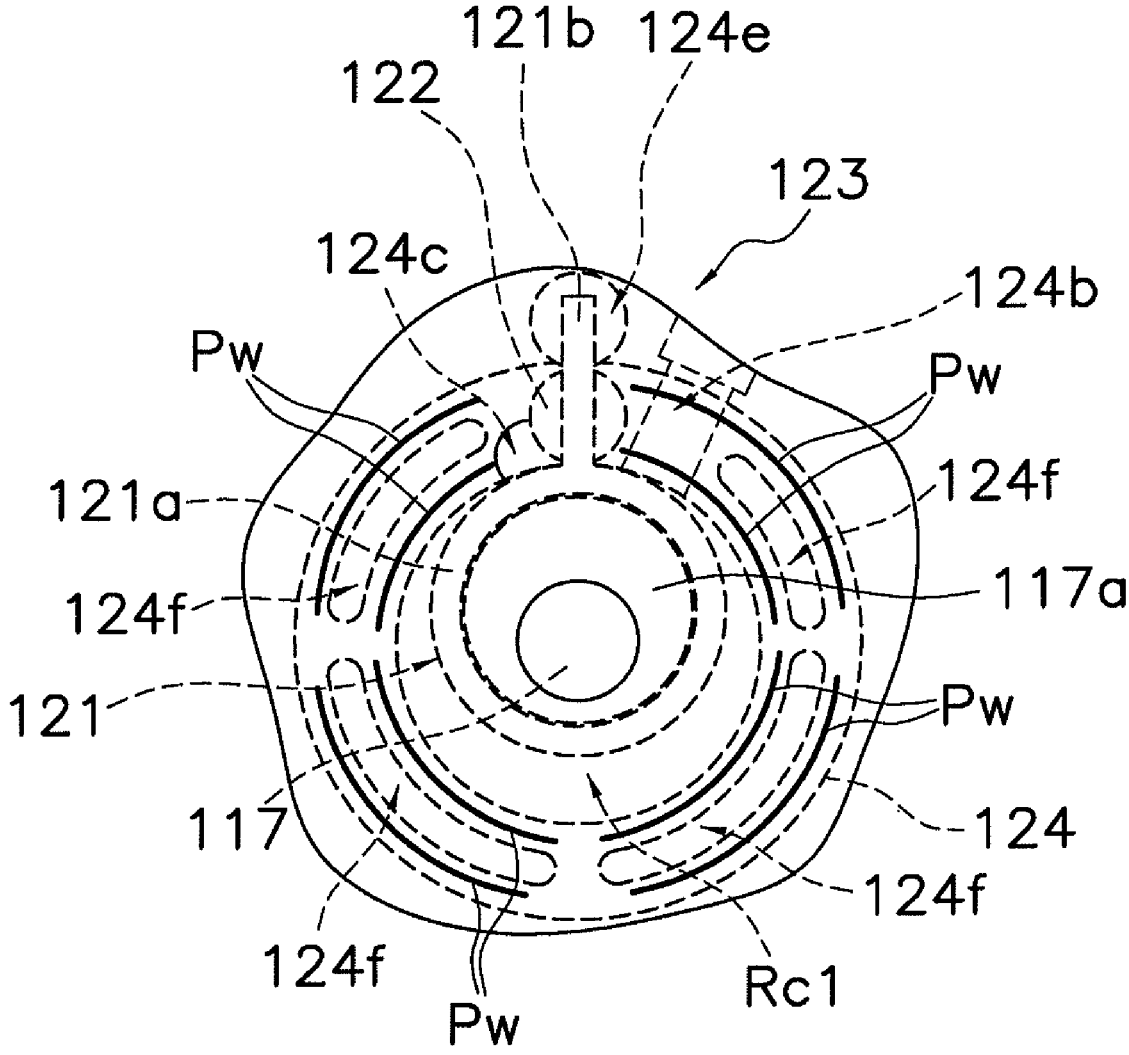
FIG. 9 is a drawing showing the penetration laser welded portion of a head according to the second embodiment (the head is depicted partially).

In the clamping step, in a state in which the eccentric shaft portion 117*a* of the crankshaft 117 and the roller portion 121*a* are accommodated in the cylinder hole 124*a*, the heads 123, 125 are positioned so as to be arranged in advance and clamped to the cylinder block 124. In this clamping step, the front head 123 and the rear head 125 may be clamped to the cylinder block 124 simultaneously, or either head 123, 125 may be first clamped alone. In cases in which only one of the heads 123, 125 is clamped, the one head 123 is joined by penetration laser welding to the cylinder block 124, and the other head 123, 125 is then clamped and joined by penetration laser welding. In the penetration laser welding step, laser light rays LS are directed from the direction shown by the solid line arrows in FIG. 8 onto the heads 123, 125 clamped to the cylinder block 124, and the heads 123, 125 are joined by penetration laser welding to the cylinder block 124. In the second embodiment, the laser output is set to 4 to 5 kW. In the second embodiment, the welded positions Pw of the heads 123, 125 are positions on the heads 123, 125 corresponding to the areas between the cylinder hole 124*a* and the thermal insulation grooves 124*f* in the cylinder block 124, or, more precisely, positions on the heads 123, 125 corresponding to positions separated outward by 3 mm from the internal peripheral surface of the cylinder hole 124*a* in the cylinder block 124, and positions on the heads 123, 125 corresponding to areas farther out than the thermal insulation grooves 124*f* in the cylinder block 124, as shown in FIG. 9. To ensure that the piston 121 will swing and that the bushing 122 will rotate, penetration laser welding is not performed in the positions corresponding to the blade portion 121*b* of the piston 121 and the bushing 122. In the second embodiment, no bolts are used in the assembling of the swing compression mechanism 115.

<Operation of Swing Compressor>

When the drive motor 116 is driven, the eccentric shaft portion 117*a* rotates eccentrically around the crankshaft 117, and the roller portion 121*a* fitted over the eccentric shaft portion 117*a* revolves with its external peripheral surface in contact with the internal peripheral surface of the cylinder chamber Rc1. As the roller portion 121*a* revolves within the cylinder chamber Rc1, the blade portion 121*b* advances and withdraws while being held on both sides by the bushing 122. The low-pressure refrigerant gas is then drawn into the suction chamber through the intake port 119 and compressed to a high pressure in the discharge chamber, and high-pressure refrigerant gas is then discharged through the discharge channel 124*c*.

<Characteristics of Swing Compressor>

(1)

In the swing compressor 101 according to the second embodiment, the heads 123, 125 are joined to the cylinder block 124 by penetration laser welding at positions corresponding to positions separated outward by 3 mm from the internal peripheral surface of the cylinder hole 124*a*. Therefore, in this swing compressor 101, the heads 123, 125 can be joined to the cylinder block 124 without the use of bolts to create a swing compression mechanism 115. Consequently, in this swing compressor 101, joining strain caused by bolting can be prevented, and the diameter can be reduced. As a result, with this swing compressor 101, strain can be eliminated in the swing compression mechanism 115 while the manufacturing costs are reduced, and, moreover, the compressor can be reduced in diameter.

(2)

In the swing compressor 101 according to the second embodiment, the heads 123, 125 are made thinner to be capable of being joined by penetration laser welding at positions corresponding to positions separated outward by 3 mm from the internal peripheral surface of the cylinder hole 124*a*. Therefore, in this swing compressor 101, the heads 123, 125 can be joined by penetration laser welding to the cylinder block 124.

(3)

In the swing compressor 101 according to the second embodiment, the heads 123, 125 are joined with the cylinder block 124 by penetration laser welding along the axial direction 101*a* of the crankshaft 117. Therefore, in this swing compressor 101, the heads 123, 125 can be easily joined to the cylinder block 124.

(4)

In the swing compressor 101 according to the second embodiment, the front head 123 and the rear head 125 are joined by penetration laser welding to the cylinder block 124 at positions corresponding to the areas between the cylinder hole 124*a* and the thermal insulation grooves 124*f* of the cylinder block 124, and at positions corresponding to areas farther out than the thermal insulation grooves 124*f* of the cylinder block 124. Therefore, in this swing compressor 101, airtightness can be ensured in the thermal insulation grooves 124*f*. Consequently, with this swing compressor 101, nonuniformity in volumetric efficiency among finished products can be reduced.

(5)

In the swing compressor 101 according to the second embodiment, the front head 123, the rear head 125, and the cylinder block 124 are formed by semi-molten die casting. Therefore, in this swing compressor 101, in addition to the use of laser welding to join the heads 123, 125 with the cylinder block 124, good breaking-in characteristics are imparted to the cylinder block 124 and the roller portion 121*a*, sufficient compressive strength is obtained in the cylinder block 124 and the heads 123, 125, and the like.

(6)

In the swing compressor 101 according to the second embodiment, no bolts are used in the assembling of the swing compression mechanism 115. Therefore, in this swing compressor 101, there is no need to provide bolt holes in the front head 123, the cylinder block 124, and the rear head 125. Therefore, the swing compressor 101 can be reduced in diameter. Since the cost of bolts used in the past is not a factor, the manufacturing cost of the swing compressor 101 is reduced.

<Modified Examples of Second Embodiment>

(A)

Figure 10:
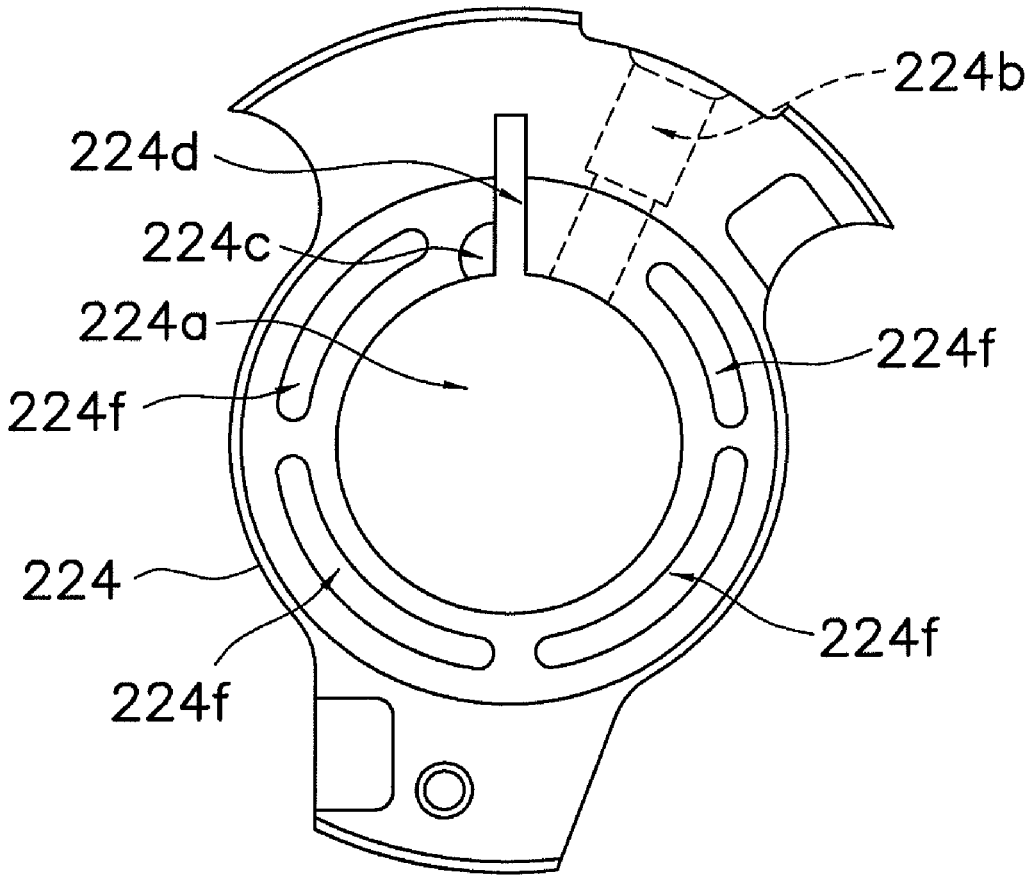
FIG. 10 is a top view of a cylinder block constituting a rotary compressor according to modified example (A) of the second embodiment.
Figure 11:
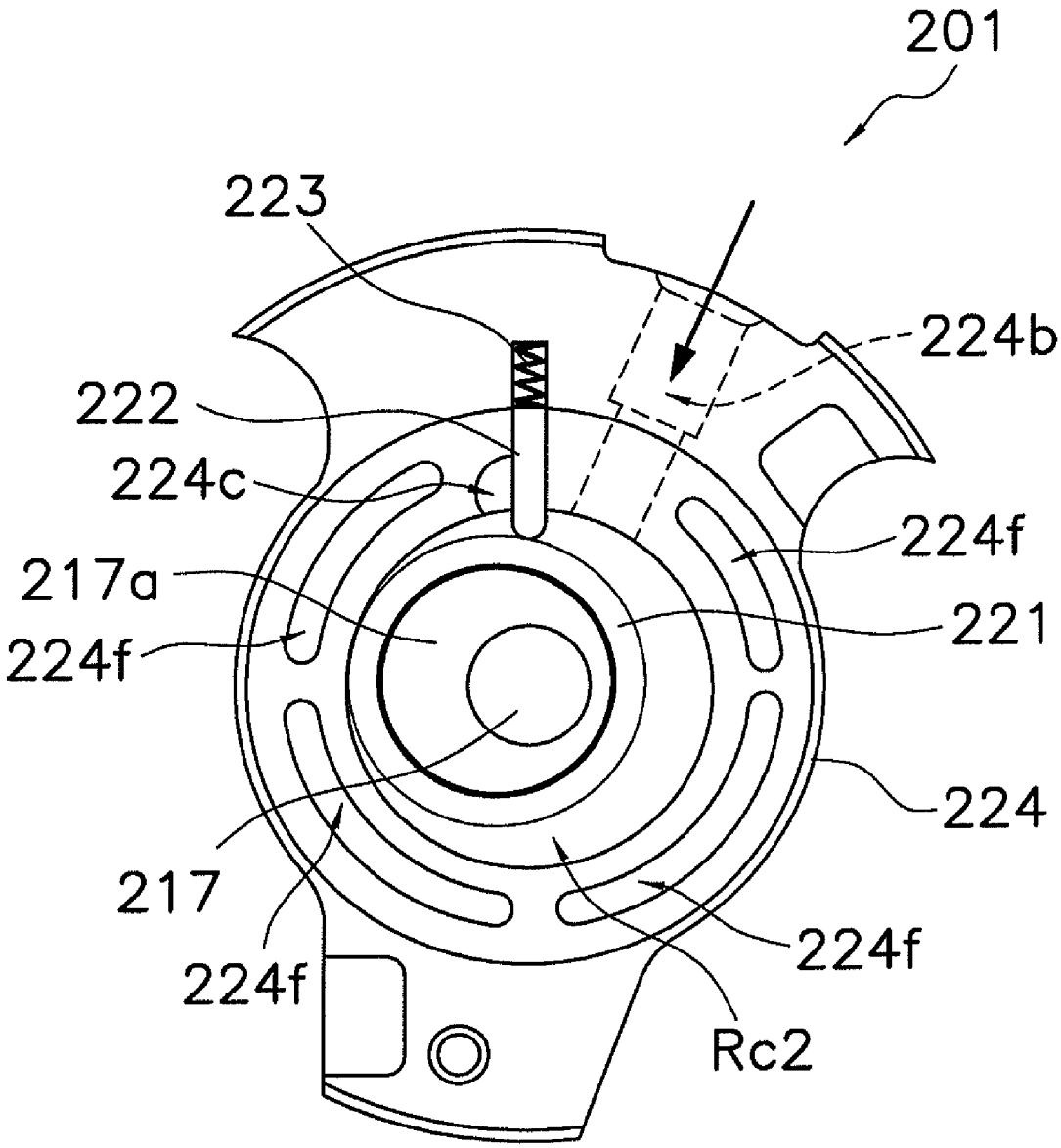
FIG. 11 is a transverse cross-sectional view of the compressor mechanism in a rotary compressor according to modified example (A) of the second embodiment.

In the swing compressor 101 according to the second embodiment, the heads 123, 125 are joined to the cylinder block 124 by penetration laser welding to assemble the swing compression mechanism 115. This type of assembly technique may also be applied to a cylinder block 224 and heads (not shown, but same as the heads 123, 125 according to the second embodiment) of a rotary compressor 201 such as is shown in FIG. 11. In other words, the front head and rear heads of the rotary compressor 201 may be joined by penetration laser welding to the cylinder block 224 and joined at positions corresponding to positions separated outward by 3 mm from the internal peripheral surface of the cylinder hole 224*a* in the cylinder block 224 (these positions must be within areas corresponding to areas between the cylinder hole 224*a* and the thermal insulation grooves 224*f* in the cylinder block 224), and at positions corresponding to areas farther out than the thermal insulation grooves 224*f* in the cylinder block 224. In FIGS. 10 and 11, symbol 217 denotes a crankshaft, 217*a* denotes an eccentric shaft portion of the crankshaft, 221 denotes a roller, 222 denotes a vane, 223 denotes a spring, 224*b* denotes a suction hole, 224*c* denotes a discharge channel, 224*d* denotes a vane accommodation hole, and Rc2 denotes a cylinder chamber.

(B)

Figure 12:
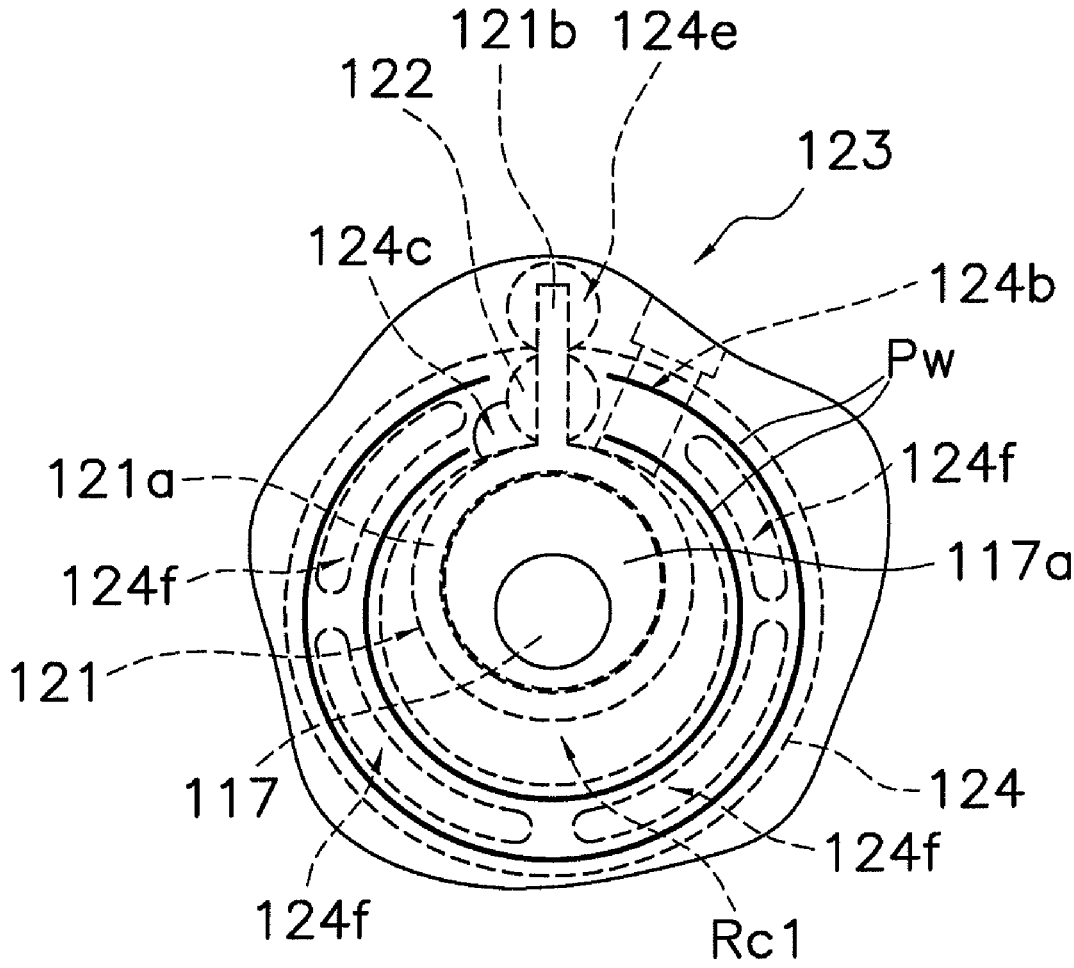
FIG. 12 is a drawing showing the penetration laser welded portion of a head according to modified example (B) of the second embodiment (the head is depicted partially).

In the swing compressor 101 according to the second embodiment, penetration laser welding is primarily performed non-continuously at positions in the heads 123, 125 corresponding to the areas between the cylinder hole 124*a* and the thermal insulation grooves 124*f* in the cylinder block 124, and at positions in the heads 123, 125 corresponding to areas farther out than the thermal insulation grooves 124*f* in the cylinder block 124; and the heads 123, 125 are joined to the cylinder block 124. However, penetration laser welding may be performed continuously as shown in FIG. 12. The airtightness between the cylinder hole 124*a* and the thermal insulation grooves 124*f* can thus be improved, as can the airtightness in the thermal insulation grooves 124*f*.

(C)

Figure 13:
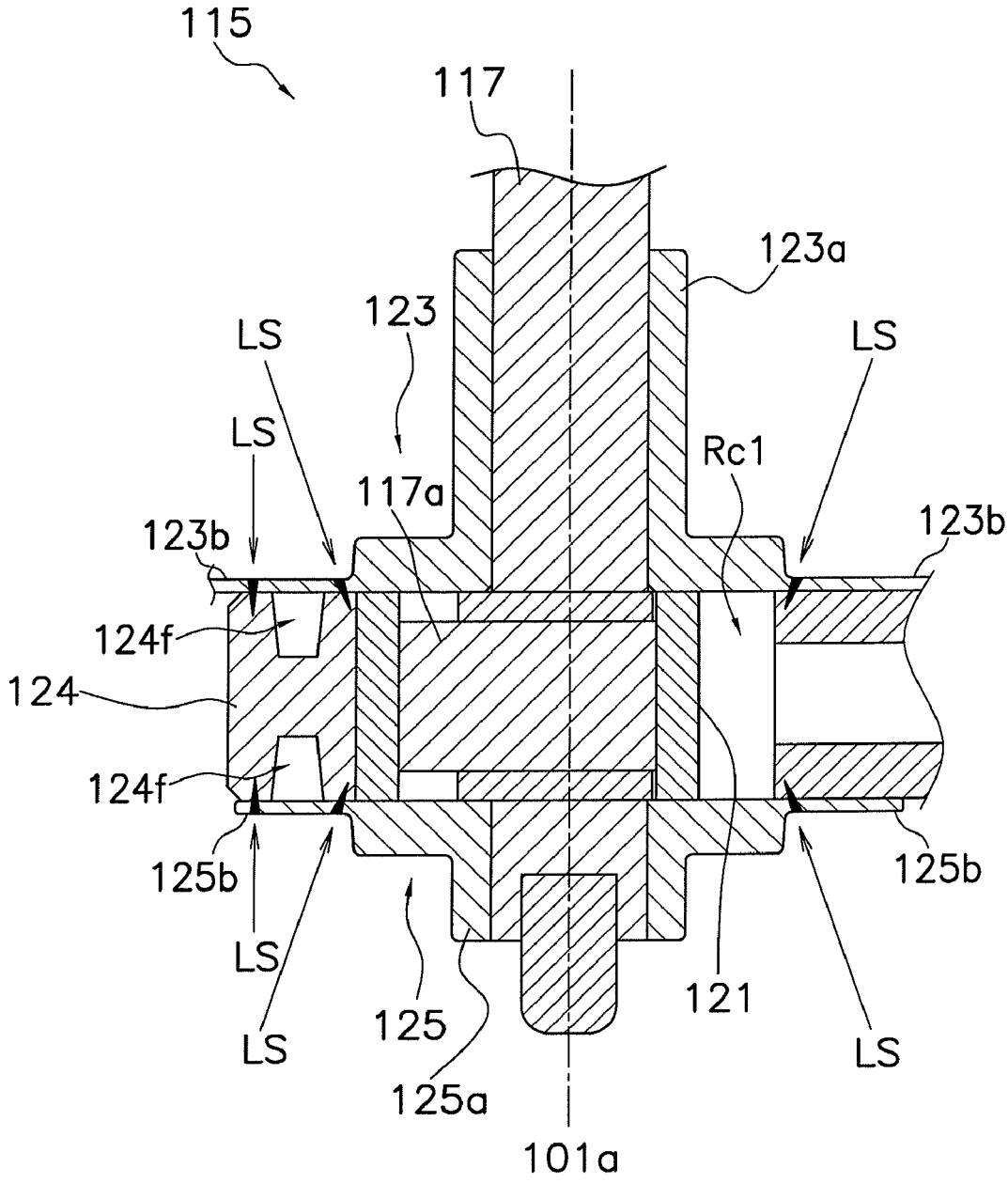
FIG. 13 is a drawing showing the direction of laser irradiation according to modified example (C) of the second embodiment.

In the swing compressor 101 according to the second embodiment, the laser light rays LS are directed along the axis 101*a* of the crankshaft 117, but the direction of the laser light rays LS may also be inclined in relation to the axis 101*a* of the crankshaft 117, as shown in FIG. 13.

(D)

Figure 14:
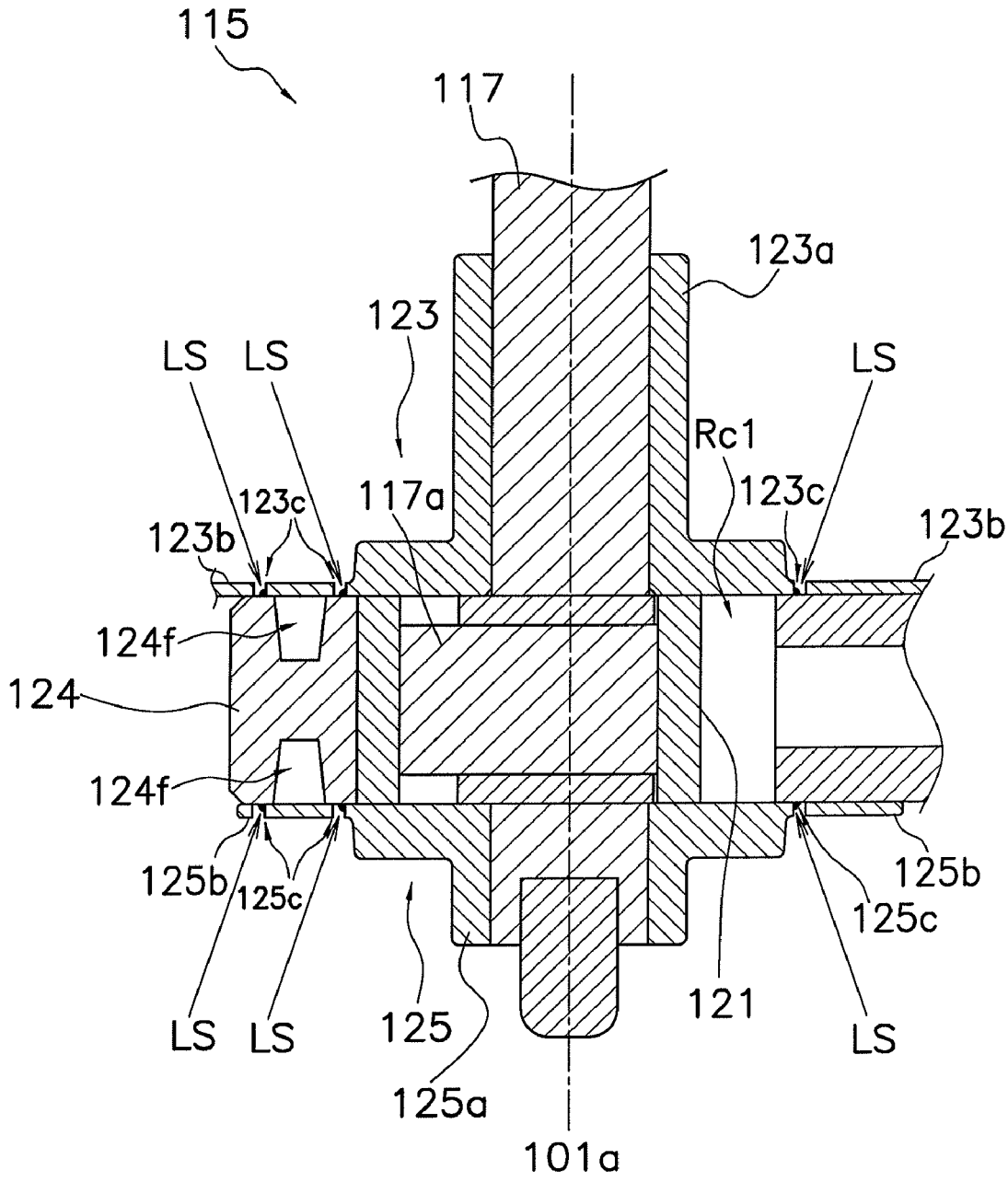
FIG. 14 is a drawing showing an aspect of fillet welding according to modified example (D) of the second embodiment.

In the swing compressor 101 according to the second embodiment, the heads 123, 125 are joined by penetration laser welding to the cylinder block 124. However, through-grooves 123*c*, 125*c* may be provided as shown in FIG. 14 at positions in the heads 123, 125 corresponding to the positions between the cylinder hole 124*a* and the thermal insulation grooves 124*f* in the cylinder block 124, and at positions in the heads 123, 125 corresponding to the areas farther out than the thermal insulation grooves 124*f* in the cylinder block 124; and the walls of these through-grooves 123*c*, 125*c* may be fillet welded to the cylinder block 124. In such cases, laser welding may be performed using a filler, or laser welding may be performed without the use of a filler.

(E)

In the swing compressor 101 according to the second embodiment, the thermal insulation grooves 124*f* are formed on both the top and bottom sides, but thermal insulation grooves may also be formed through the plate thickness direction, as is the cylinder hole 124*a*.

(F)

In the swing compressor 101 according to the second embodiment, four thermal insulation grooves 124*f* are formed separately, but the thermal insulation grooves may also be formed so that all of the thermal insulation grooves communicate with each other.

(G)

The swing compressor 101 according to the second embodiment is a single cylinder type swing compressor, but the assembly technique for the swing compression mechanism 115 according to the present invention can also be applied to a two-cylinder type swing compressor or rotary compressor.

(H)

Figure 15:
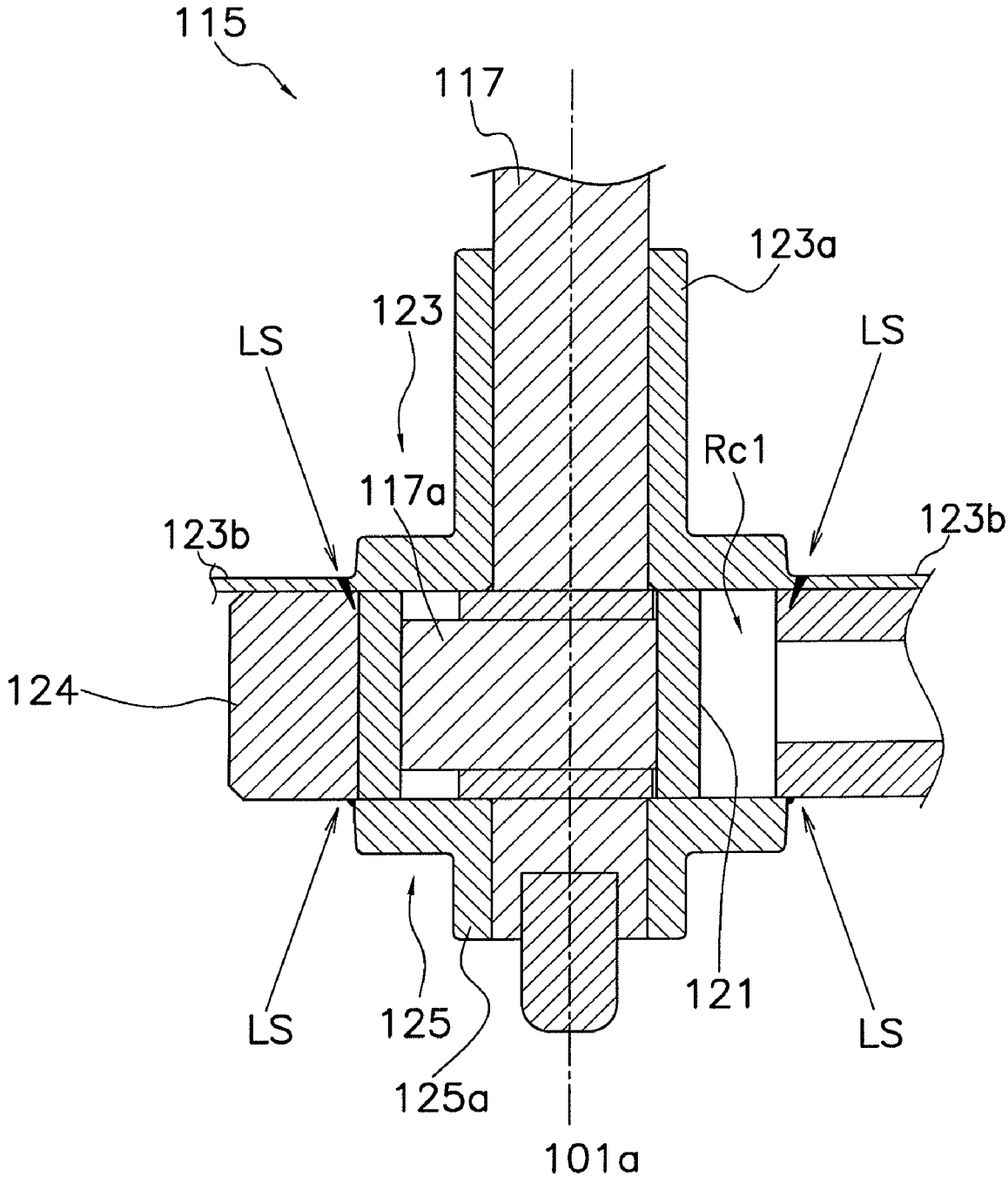
FIG. 15 is a drawing showing the laser welding of a head according to modified example (H) of the second embodiment.

In the swing compressor 101 according to the second embodiment, the cylinder block 124 may be provided with thermal insulation grooves 124*f*, but may also not be provided with thermal insulation grooves 124*f* (see FIG. 15). In such cases, the front head 123 may be joined to the cylinder block 124 by penetration laser welding only at positions corresponding to positions separated outward by 3 mm from the internal peripheral surface of the cylinder hole 124*a* in the cylinder block 124, as shown in FIG. 15. The rear head 125 also need not have a joining part 125*b* as shown in FIG. 15. In such cases, the rear head 125 may be joined by fillet welding to the cylinder block 124 at positions separated outward by a distance of from 2 mm or more to 4 mm or less from the internal peripheral surface of the cylinder hole 124*a* of the cylinder block 124. In such cases, laser welding may be performed using a filler, or laser welding may be performed without the use of a filler.

(I)

In the swing compressor 101 according to the second embodiment, the heads 123, 125 are joined to the cylinder block 124 by penetration laser welding at positions corresponding to positions separated outward by 3 mm from the internal peripheral surface of the cylinder hole 124*a* in the cylinder block 124, but the penetration laser welding can also be performed at positions in the heads 123, 125 corresponding to positions separated outward by a distance of from 2 mm or more to 4 mm or less from the internal peripheral surface of the cylinder hole 124*a* in the cylinder block 124.

(J)

In the swing compressor 101 according to the second embodiment, the joining parts 123*b*, 125*b* of the front head 123 and the rear head 125 have a thickness of 2 mm, and the laser output during penetration laser welding is 4 to 5 kW. However, if the laser output is 4 to 5 kW, the thickness of the joining parts 123*b*, 125*b* can be 3 mm or less. In cases in which the laser output can be increased, the thickness of the joining parts 123*b*, 125*b* may be greater than 3 mm. The thickness can be reduced if the laser output cannot be increased greater than 4 kW.

(H)

In the swing compressor 101 according to the second embodiment, the swing compression mechanism 115 is assembled without bolts. However, bolts may also be used in addition to penetration laser welding in the assembly of the swing compression mechanism 115.

Third Embodiment

Figure 16:
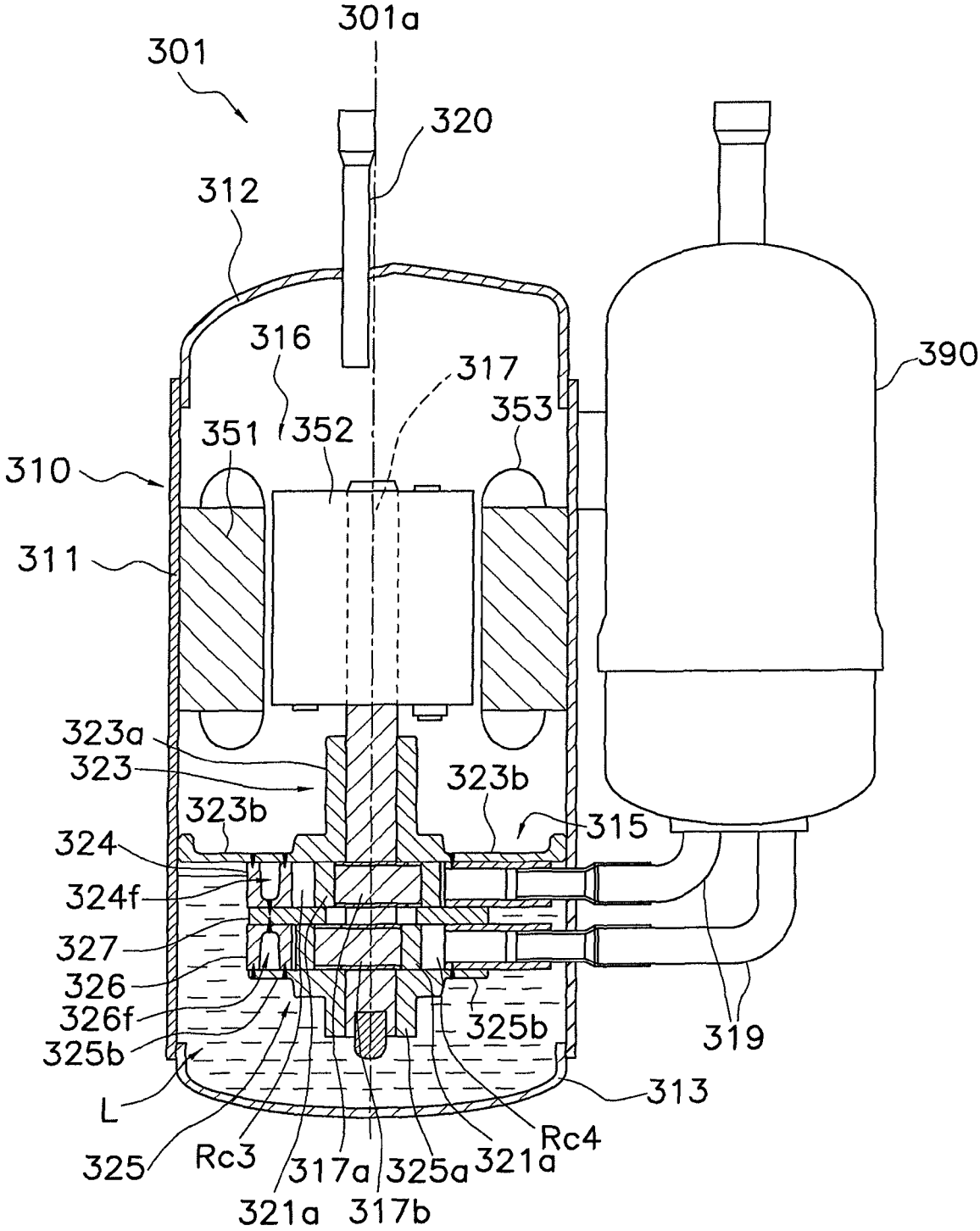
FIG. 16 is a longitudinal sectional view of a swing compressor according to the third embodiment.

A swing compressor 301 according to the third embodiment is a two-cylinder type swing compressor, and is configured primarily from a cylindrical airtight dome type casing 310, a swing compression mechanism 315, a drive motor 316, a suction tube 319, a discharge tube 320, and a terminal (not shown), as shown in FIG. 16. An accumulator (gas-liquid separator) 390 is attached to the casing 310 in this swing compressor 301. The constituent elements of this swing compressor 301 are described in detail hereinbelow.

<Details of Structural Components of Swing Compressor>

(1) Casing

The casing 310 has a substantially cylindrical trunk casing 311, a bowl-shaped upper wall portion 312 welded in airtight manner to the upper end of the trunk casing 311, and a bowl-shaped bottom wall 313 welded in airtight manner to the lower end of the trunk casing 311. This casing 310 primarily accommodates the swing compression mechanism 315 for compressing a gas refrigerant, and the drive motor 316 disposed above the swing compression mechanism 315. The swing compression mechanism 315 and the drive motor 316 are connected by a crankshaft 317 disposed so as to extend in the vertical direction inside the casing 310.

(2) Swing Compression Mechanism

Figure 18:
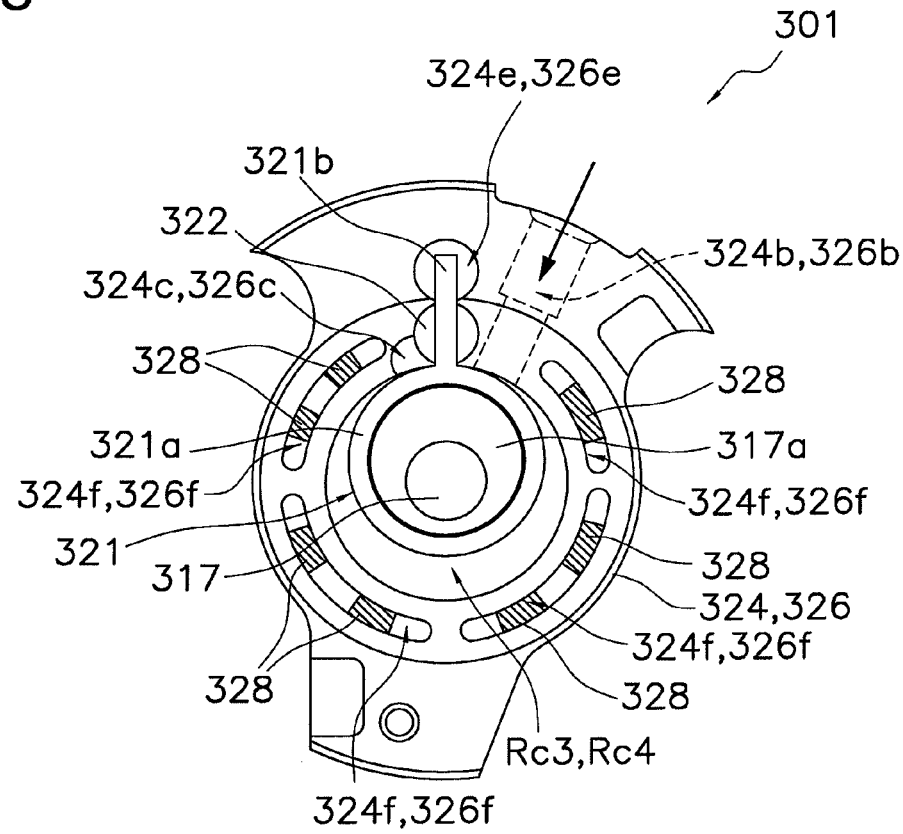
FIG. 18 is a transverse cross-sectional view of a compression mechanism constituting the swing compressor according to the third embodiment.

The swing compression mechanism 315 is configured primarily from a front head 323, a first cylinder block 324, a middle plate 327, a second cylinder block 326, a rear head 325, the crankshaft 317, a piston 321, and a bushing 322, as shown in FIGS. 16 and 18. In the third embodiment, the front head 323, the first cylinder block 324, the middle plate 327, the second cylinder block 326, and the rear head 325 are integrally joined by penetration laser welding. In the third embodiment, the swing compression mechanism 315 is immersed in lubricating oil retained in the bottom of the casing 310, and lubricating oil L is fed by differential pressure to the swing compression mechanism 315. The constituent elements of the swing compression mechanism 315 are described in detail hereinbelow.

a) First Cylinder Block

Figure 17:
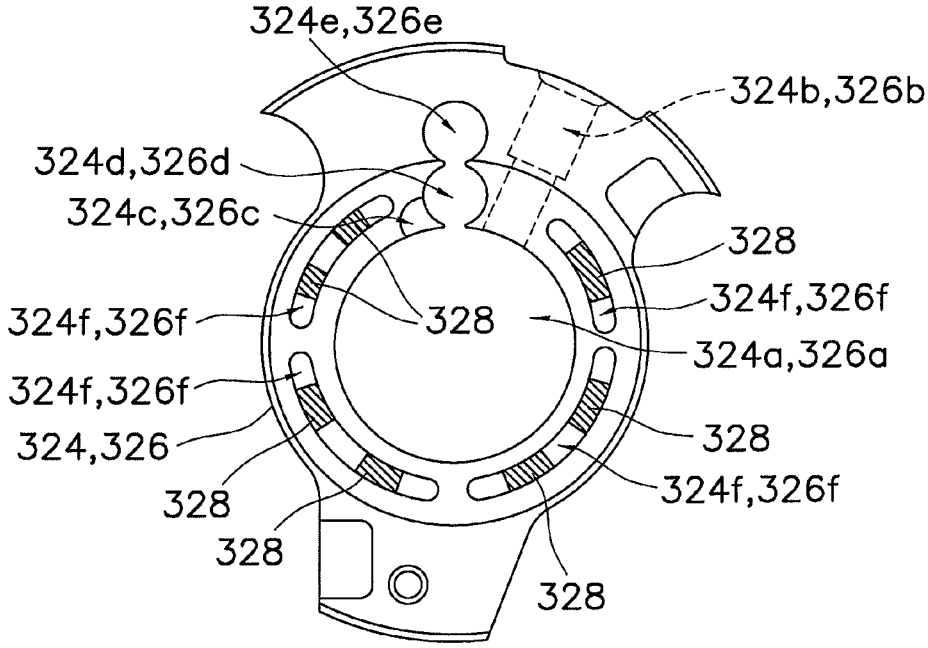
FIG. 17 is a top view of a cylinder block constituting the swing compressor according to the third embodiment.

Formed in the first cylinder block 324 are a cylinder hole 324*a*, a suction hole 324*b*, a discharge channel 324*c*, a bushing accommodation hole 324*d*, a blade accommodation hole 324*e*, and thermal insulation grooves 324*f*, as shown in FIG. 17. The cylinder hole 324*a* is a cylindrical through-hole formed along the plate thickness direction as shown in FIGS. 16 and 17. The suction hole 324*b* passes through the cylinder hole 324*a* from the external peripheral wall surface. The discharge channel 324*c* is formed by notched portion of the internal peripheral side of the cylinder forming the cylinder hole 324*a*. The bushing accommodation hole 324*d* is a through-hole formed along the plate thickness direction and is disposed between the suction hole 324*b* and the discharge channel 324*c* as seen along the plate thickness direction. The blade accommodation hole 324*e* is a through-hole formed along the plate thickness direction and communicates with the bushing accommodation hole 324*d*. The thermal insulation grooves 324*f* are a plurality of grooves formed in the direction through the cylinder hole 324*a*, the purpose of which is to insulate a cylinder chamber Rc3. The first cylinder block 324 is also provided with joining parts 328 inside the thermal insulation grooves 324*f* at the end opposite from the side on which the discharge channel 324*c* is formed (see FIG. 17). The joining parts 328 are provided integrally with the first cylinder block 324. These joining parts 328 are made thinner so as to be capable of being joined by penetration laser welding.

In the first cylinder block 324, an eccentric shaft portion 317*a* of the crankshaft 317 and a roller portion 321*a* of the piston 321 are accommodated in the cylinder hole 324*a*; a blade portion 321*b* of the piston 321 and the bushing 322 are accommodated in the bushing accommodation hole 324*d*; and the blade portion 321*b* of the piston 321 is accommodated in the blade accommodation hole 324*e*. In this state, the first cylinder block 324 is joined to the front head 323 and the middle plate 327 so that the discharge channel 324*c* faces the front head 323 (see FIG. 18). As a result, the third cylinder chamber Rc3 is formed in the swing compression mechanism 315, and this third cylinder chamber Rc3 is partitioned by the piston 321 into a suction chamber communicated with the suction hole 324*b* and a discharge chamber communicated with the discharge channel 324*c*.

b) Second Cylinder Block

Similar to the first cylinder block 324, a cylinder hole 326*a*, a suction hole 326*b*, a discharge channel 326*c*, a bushing accommodation hole 326*d*, a blade accommodation hole 326*e*, and thermal insulation grooves 326*f* are formed in the second cylinder block 326, as shown in FIG. 17. The cylinder hole 326*a* is a cylindrical through-hole formed along the plate thickness direction as shown in FIGS. 16 and 17. The suction hole 326*b* passes through the cylinder hole 326*a* from the external peripheral wall surface. The discharge channel 326*c* is formed by forming a notch in a portion of the internal peripheral side of the cylinder portion that forms the cylinder hole 326*a*. The bushing accommodation hole 326*d* is a through-hole formed along the plate thickness direction and disposed between the suction hole 326*b* and the discharge channel 326*c* as seen along the plate thickness direction. The blade accommodation hole 326*e* is a through-hole formed along the plate thickness direction and communicates with the bushing accommodation hole 326*d*. The thermal insulation grooves 326*f* are a plurality of grooves formed in the direction through the cylinder hole 326*a*, the purpose of which is to insulate a cylinder chamber Rc4. The second cylinder block 326 is also provided with joining parts 328 inside the thermal insulation grooves 326*f* at the end opposite from the side on which the discharge channel 326*c* is formed (see FIG. 16). The joining parts 328 are provided integrally with the second cylinder block 326. These joining parts 328 are made thinner so as to be capable of being joined by penetration laser welding.

In this second cylinder block 326, an eccentric shaft portion 317*b* of the crankshaft 317 and the roller portion 321*a* of the piston 321 are accommodated in the cylinder hole 326*a*, the blade portion 321*b* of the piston 321 and the bushing 322 are accommodated in the bushing accommodation hole 326*d*, and the blade portion 321*b* of the piston 321 is accommodated in the blade accommodation hole 326*e*. In this state, the second cylinder block 326 is fitted in the rear head 325 and the middle plate 327 so that the discharge channel faces the rear head 325 (see FIG. 18). As a result, the fourth cylinder chamber Rc4 is formed in the swing compression mechanism 315, and the fourth cylinder chamber Rc4 is partitioned by the piston 321 into a suction chamber communicated with the suction hole 326*b* and a discharge chamber communicated with the discharge channel 326*c*.

c) Crankshaft

The crankshaft 317 has two eccentric shaft portions 317*a*, 317*b* provided to one of the end portions. The two eccentric shaft portions 317*a*, 317*b* are formed so that the eccentric axes thereof face each other across the center axis of the crankshaft 317. The crankshaft 317 is secured to the rotor 352 of the drive motor 316 on the side on which the eccentric shaft portions 317*a*, 317*b* are not provided.

d) Piston

The piston 321 has a substantially cylindrical roller portion 321*a*, and a blade portion 321*b* that protrudes outward in the radial direction of the roller portion 321*a*. The roller portion 321*a* is fitted into the eccentric shaft portions 317*a*, 317*b* of the crankshaft 317, and is inserted in this state into the cylinder holes 324*a*, 326*a* of the cylinder blocks 324, 326. The roller portion 321*a* thereby moves in an orbiting fashion about the rotational axis of the crankshaft 317 when the crankshaft 317 rotates. The blade portion 321*b* is accommodated in the bushing accommodation holes 324*d*, 326*d* and the blade accommodation holes 324*e*, 326*e*. The blade portion 321*b* thereby swings and simultaneously moves in a reciprocationg fashion in the lengthwise direction.

e) Bushing

The bushings 322 are substantially semicylindrical members and are accommodated in the bushing accommodation holes 324*d*, 326*d* so as to hold the blade portion 321*b* of the piston 321.

f) Front Head

The front head 323 is a member that covers the first cylinder block 324 on the side facing the discharge channel 324*d* and is joined to the casing 310. A bearing portion 323*a* is formed on the front head 323, and the crankshaft 317 is inserted into the bearing portion 323*a*. Also formed in the front head 323 is an opening (not shown) for feeding to the discharge tube 320 a refrigerant gas that flows through the discharge channel 324*c* formed in the first cylinder block 324. The opening can be opened and closed by a discharge valve (not shown) to prevent the backflow of refrigerant gas. The front head 323 is also provided with a joining part 323*b*. The joining part 323*b* is made thinner so as to be amenable to penetration laser welding, and the thickness thereof is 2 mm. In the third embodiment, the term "joining part 323*b*" specifically refers to an area in the front head 323 that corresponds to an area separated outward by 2 mm or more from the internal peripheral surface of the cylinder hole 324*a* of the first cylinder block 324.

g) Rear Head

The rear head 325 covers the second cylinder block 326 on the side of the discharge channel 326*c*. A bearing portion 325*a* is formed on the rear head 325, and the crankshaft 317 is inserted into the bearing portion 325*a*. Also, an opening (not shown) for feeding a refrigerant gas that flows through the discharge channel 326*c* formed in the second cylinder block 326 into the discharge tube 320 is formed in the rear head 325. This opening is opened and closed by a discharge valve (not shown) to prevent the backflow of refrigerant gas. The rear head 325 is also provided with a joining part 325*b*. Similar to the joining part 323*a* of the front head 323, the joining part 325*b* is made thinner so as to be amenable to penetration laser welding, and the thickness thereof is 2 mm. In the third embodiment, the term "joining part 325*b*" specifically refers to an area in the rear head 325 that corresponds to an area separated outward by 2 mm or more from the internal peripheral surface of the cylinder hole 326*a* of the second cylinder block 326.

h) Middle Plate

The middle plate 327 is disposed between the first cylinder block 324 and the second cylinder block 326, and partitions the third cylinder chamber Rc3 and the fourth cylinder chamber Rc4. In the third embodiment, the locations in which the middle plate 327 is subjected to penetration laser welding have a thickness of 2 mm.

(3) Drive Motor

The drive motor 316 is a DC motor in the third embodiment, and is primarily composed of an annular stator 351 secured to the internal wall surface of the casing 310, and a rotor 352 rotatably accommodated with a slight gap (air gap channel) on the inside of the stator 351.

Copper wire is wound about a tooth portion (not shown) of the stator 351, and a coil end 353 is formed above and below the stator. The external peripheral surface of the stator 351 is provided with core cut portions (not shown) that have been formed as a notch in a plurality of locations from the upper end surface to the lower end surface of the stator 351 at prescribed intervals in the peripheral direction.

The crankshaft 317 is secured along the rotational axis to the rotor 352.

(4) Suction Tube

The suction tube 319 is provided so as to pass through the casing 310, and has one end that is fitted into the suction holes 324*b*, 326*b* formed in the first cylinder block 324 and the second cylinder block 326, and the other end is fitted into the accumulator 390.

(5) Discharge Tube

The discharge tube 320 is provided so as to pass through the upper wall portion 312 of the casing 310.

(6) Terminal

The terminal (not shown) is configured primarily from terminal pins (not shown) and terminal bodies (not shown). The terminal pins are supported by the terminal bodies, and the terminal bodies are fitted in and welded to the upper wall portion 312 of the casing 310. A lead wire (not shown) extending from the coil end 353 is connected to the sides of the terminal pins inside the casing 310, and an external power source (not shown) is connected to the sides of the terminal pins outside the casing 310.

<Method for Manufacturing Primary Components>

In the swing compressor 301 according to the third embodiment, the piston 321, the cylinder blocks 324, 326, the front head 323, the rear head 325, the middle plate 327, and the crankshaft 317 are manufactured in the same manner as in the second embodiment.

<Assembling the Swing Compression Mechanism>

In the third embodiment, the swing compression mechanism 315 is manufactured via a cylinder block/middle plate joining step and a cylinder block/head joining step.

Figure 19:
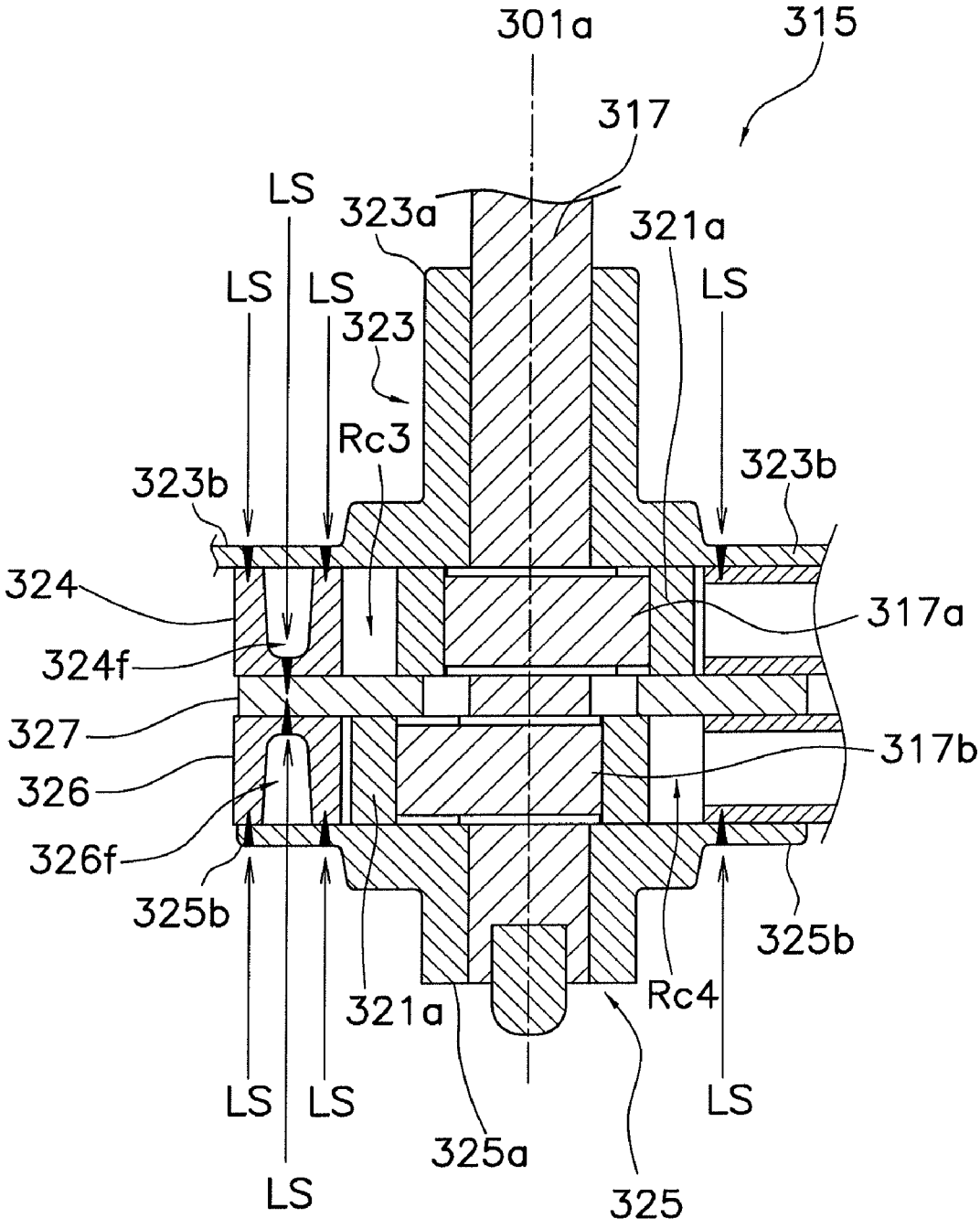
FIG. 19 is a drawing showing the direction of laser irradiation in the penetration laser welding according to the third embodiment.

In the cylinder block/middle plate joining step, the cylinder blocks 324, 326 are clamped to the middle plate 327 so that there is contact between the joining parts 328 and the middle plate 327. In this state, the joining parts 328 of the cylinder blocks 324, 326 are irradiated with laser light rays LS along the axial direction 301*a* of the crankshaft 317 (refer to the solid line arrows in FIG. 19), and the joining parts 328 are joined by penetration laser welding to the middle plate 327. In the third embodiment, the laser output is set to 4 to 5 kW. In the third embodiment, the welded positions Pw of the joining parts 328 are as shown by the bold dashed lines in FIG. 20. In the cylinder block/middle plate joining step, the cylinder blocks 324, 326 may be joined by penetration laser welding to the middle plate 327 in a state in which the eccentric shaft portions 317*a*, 317*b* of the crankshaft 317 and the roller portion 321*a* are accommodated in the cylinder holes 324*a*, 326*a*, or the cylinder blocks 324, 326 may be joined by penetration laser welding to the middle plate 327 in a state in which the eccentric shaft portions 317*a*, 317*b* of the crankshaft 317 and the roller portion 321*a* are not accommodated in the cylinder holes 324*a*, 326*a*. In the latter case, after penetration laser welding is complete, the crankshaft 317 is inserted into the assembly so that the eccentric shaft portions 317*a*, 317*b* of the crankshaft 317 and the roller portion 321*a* are accommodated in the cylinder holes 324*a*, 326*a*.

Figure 20:
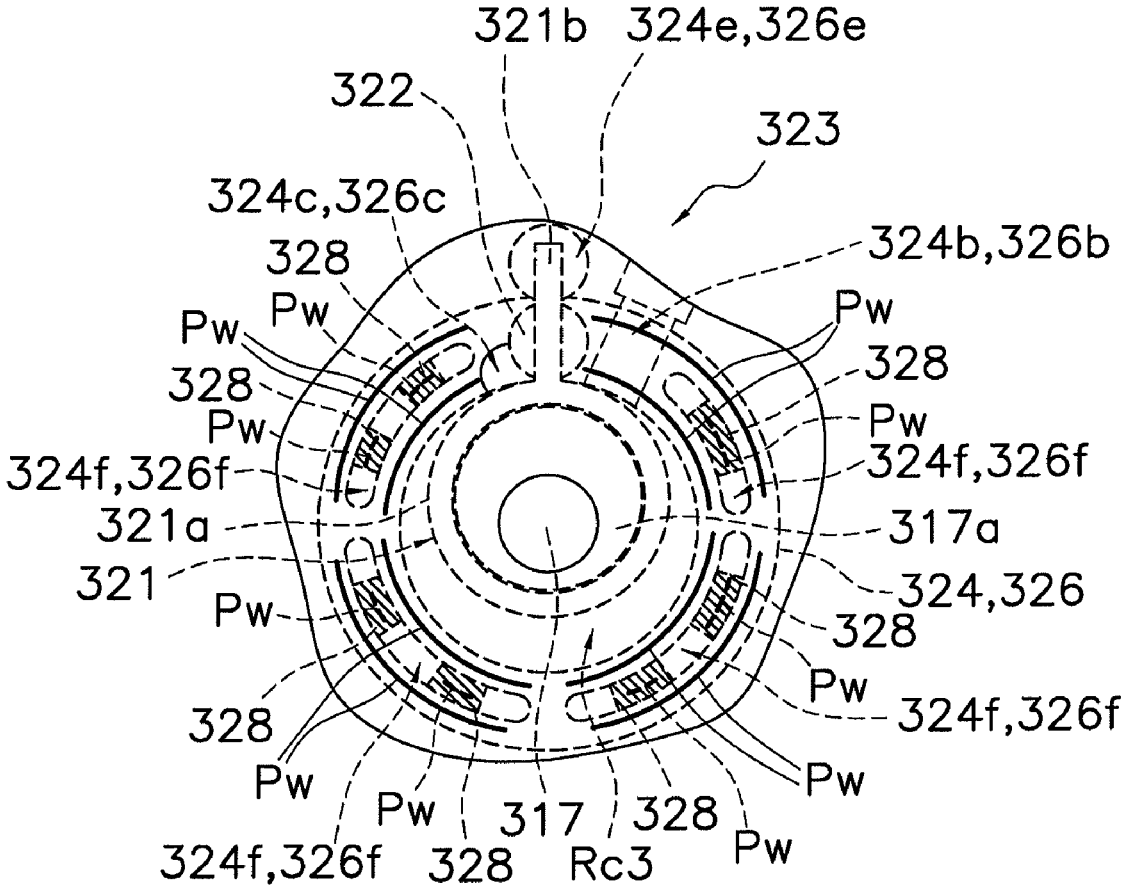
FIG. 20 is a drawing showing the penetration laser welded portions of the joining parts in the head and cylinder block according to the third embodiment (the head is depicted partially).

In the cylinder block/head joining step, the heads 323, 325 are clamped to the cylinder blocks 324, 326. In this state, the heads 323, 325 are irradiated with laser light rays LS along the axial direction 301*a* of the crankshaft 317 (refer to the solid line arrows in FIG. 19), and the heads 323, 325 are joined by penetration laser welding to the cylinder blocks 324, 326. In the third embodiment, the welded positions Pw of the heads 323, 325 are positions on the heads 323, 325 corresponding to positions separated outward by 3 mm from the internal peripheral surface of the cylinder hole 324*a* in the cylinder block 324, and positions in the heads 323, 325 corresponding to areas farther out than the thermal insulation grooves 324*f* in the cylinder block 324, as shown in FIG. 20. The positions in the heads 323, 325 corresponding to positions separated outward by 3 mm from the internal peripheral surface of the cylinder hole 324*a* in the cylinder block 324 are located within areas corresponding to areas in the cylinder block 324 between the cylinder hole 324*a* and the thermal insulation grooves 324*f*. To ensure that the piston 321 will swing and that the bushing 322 will rotate, penetration laser welding is not performed in the positions corresponding to the blade portion 321*b* of the piston 321 and the bushing 322. In the third embodiment, no bolts are used in the assembling of the swing compression mechanism 315.

<Operation of Swing Compressor>

When the drive motor 316 is driven, the eccentric shaft portions 317*a*, 317*b* rotate eccentrically around the crankshaft 317, and the roller portion 321*a* fitted over these eccentric shaft portions 317*a*, 317*b* revolves while the external peripheral surface thereof is in contact with the internal peripheral surfaces of the cylinder chambers Rc3, Rc4. As the roller portion 321*a* revolves within the cylinder chambers Rc3, Rc4, the blade portion 321*b* advances and withdraws while being held by the bushing 322 on both sides. The low-pressure refrigerant gas is then drawn into the suction chamber through the suction tube 319 and is compressed to a high pressure in the discharge chamber, and high-pressure refrigerant gas is then discharged through the discharge channels 324*c*, 326*c*.

<Characteristics of Swing Compressor>

(1)

In the swing compressor 301 according to the third embodiment, the heads 323, 325 are joined to the cylinder blocks 324, 326 by penetration laser welding at positions corresponding to positions separated outward by 3 mm from the internal peripheral surface of the cylinder hole 324*a*. In this swing compressor 301, the joining parts 328 of the cylinder blocks 324, 326 are also subjected to penetration laser welding, thereby joining the cylinder blocks 324, 326 to the middle plate 327. Therefore, in this swing compressor 301, the heads 323, 325 can be joined to the cylinder blocks 324, 326 without the use of bolts to create a two-cylinder type swing compression mechanism 315. Consequently, in this swing compressor 301, joining strain caused by bolting can be prevented, and the diameter can be reduced. As a result, with this swing compressor 301, strain can be eliminated in the swing compression mechanism 315 while the manufacturing costs are reduced, and, moreover, the compressor can be reduced in diameter.

(2)

In the swing compressor 301 according to the third embodiment, the heads 323, 325 are made thinner to be capable of being joined by penetration laser welding at positions corresponding to positions separated outward by 3 mm from the internal peripheral surfaces of the cylinder holes 324*a*, 326*a*. Therefore, in this swing compressor 301, the heads 323, 325 can be joined by penetration laser welding to the cylinder blocks 324, 326.

(3)

In the swing compressor 301 according to the third embodiment, the heads 323, 325 are joined with the cylinder blocks 324, 326 by penetration laser welding along the axial direction 301*a* of the crankshaft 317. Therefore, in this swing compressor 301, the heads 323, 325 can be easily joined to the cylinder blocks 324, 326.

(4)

In the swing compressor 301 according to the third embodiment, the front head 323 and the rear head 325 are joined by penetration laser welding to the cylinder blocks 324, 326 at positions corresponding to the positions between the cylinder holes 324*a*, 326*a* and the thermal insulation grooves 324*f*, 326*f* of the cylinder blocks 324, 326, and at positions corresponding to areas farther out than the thermal insulation grooves 324*f*, 326*f* of the cylinder blocks 324, 326. Therefore, in this swing compressor 301, airtightness can be ensured in the thermal insulation holes 324*f*, 326*f*.

(5)

In the swing compressor 301 according to the third embodiment, the front head 323, the rear head 325, the middle plate 327, and the cylinder blocks 324, 326 are formed by semi-molten die casting. Therefore, in this swing compressor 301, in addition to the use of laser welding to join the cylinder blocks 324, 326, the heads 323, 325, and the middle plate 327, good breaking-in characteristics are imparted to the cylinder blocks 324, 326 and the roller portion 321*a*, sufficient compressive strength is obtained in the cylinder blocks 324, 326 and the heads 323, 325, and the like.

(6)

In the swing compressor 301 according to the third embodiment, no bolts are used in the assembling of the swing compression mechanism 315. Therefore, in this swing compressor 301, there is no need to provide bolt holes in the front head 323, the cylinder blocks 324, 326, the middle plate 327, and the rear head 325. Therefore, the swing compressor 301 can be reduced in diameter. Since the cost of bolts used in the past is not a factor, the manufacturing cost of the swing compressor 301 is reduced.

<Modified Examples of Third Embodiment>

(A)

Figure 21:
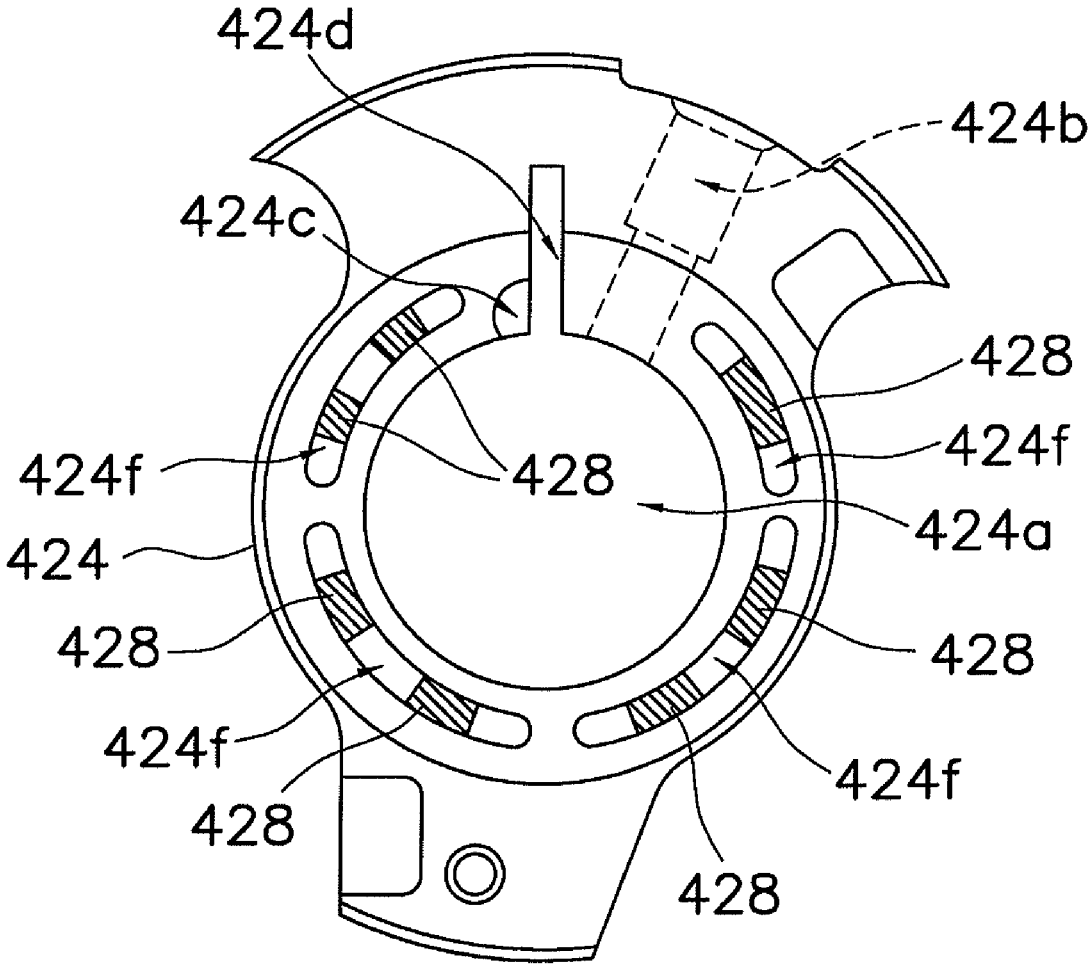
FIG. 21 is a top view of a cylinder block constituting the rotary compressor according to modified example (A) of the third embodiment.
Figure 22:
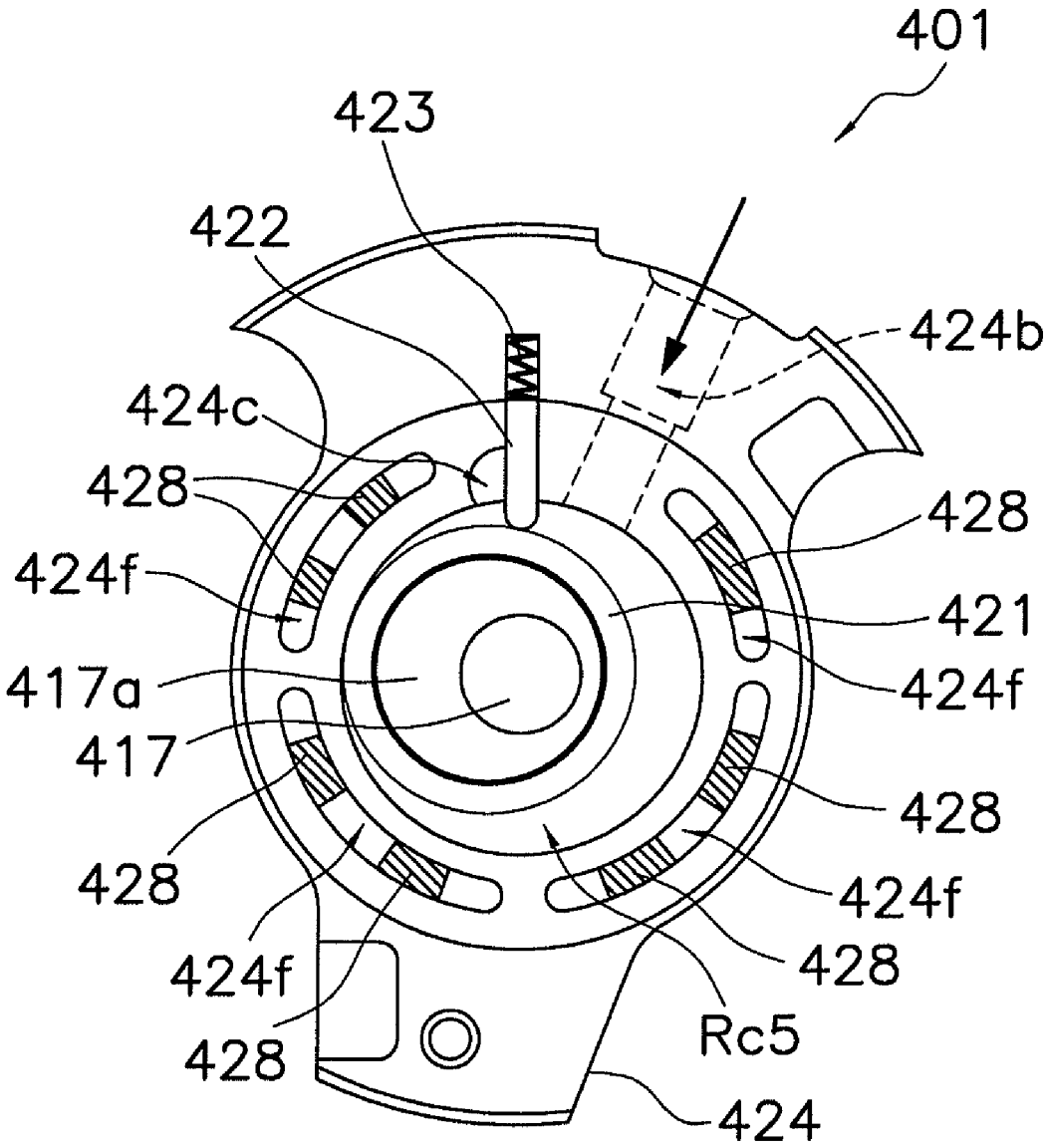
FIG. 22 is a transverse cross-sectional view of the compression mechanism of the rotary compressor according to modified example (A) of the third embodiment.

In the swing compressor 301 according to the third embodiment, the joining parts 328 of the cylinder blocks 324, 326 are joined to the middle plate 327 by penetration laser welding, and furthermore, the heads 323, 325 are joined to the cylinder blocks 324, 326 by penetration laser welding to assemble a two-cylinder type swing compression mechanism 315. This type of assembly technique may also be applied to a cylinder block 424 and heads (though not shown, the same heads as the heads 323, 325 in the third embodiment) of a rotary compressor 401 such as is shown in FIG. 22. In other words, in a two-cylinder type rotary compressor 401, the front head and the rear head may be joined by penetration laser welding to the cylinder block 424 at positions corresponding to positions separated outward by 3 mm from the internal peripheral surface of a cylinder hole 424*a* in the cylinder block 424 (these positions must be within areas corresponding to areas between the cylinder hole 424*a* and thermal insulation grooves 424*f* in the cylinder block 424), and positions corresponding to areas farther out than the thermal insulation grooves 424*f* in the cylinder block 424. The heads may also be joined to a middle plate (not shown) by performing penetration laser welding on the joining parts 428 of the cylinder block 424. In FIGS. 21 and 22, symbol 417 denotes a crankshaft, 417*a* denotes an eccentric shaft portion of the crankshaft, 421 denotes a roller, 422 denotes a vane, 423 denotes a spring, 424*b* denotes a suction hole, 424*c* denotes a discharge channel, 424*d* denotes a vane accommodation hole, and Rc5 denotes a cylinder chamber.

(B)

Figure 23:
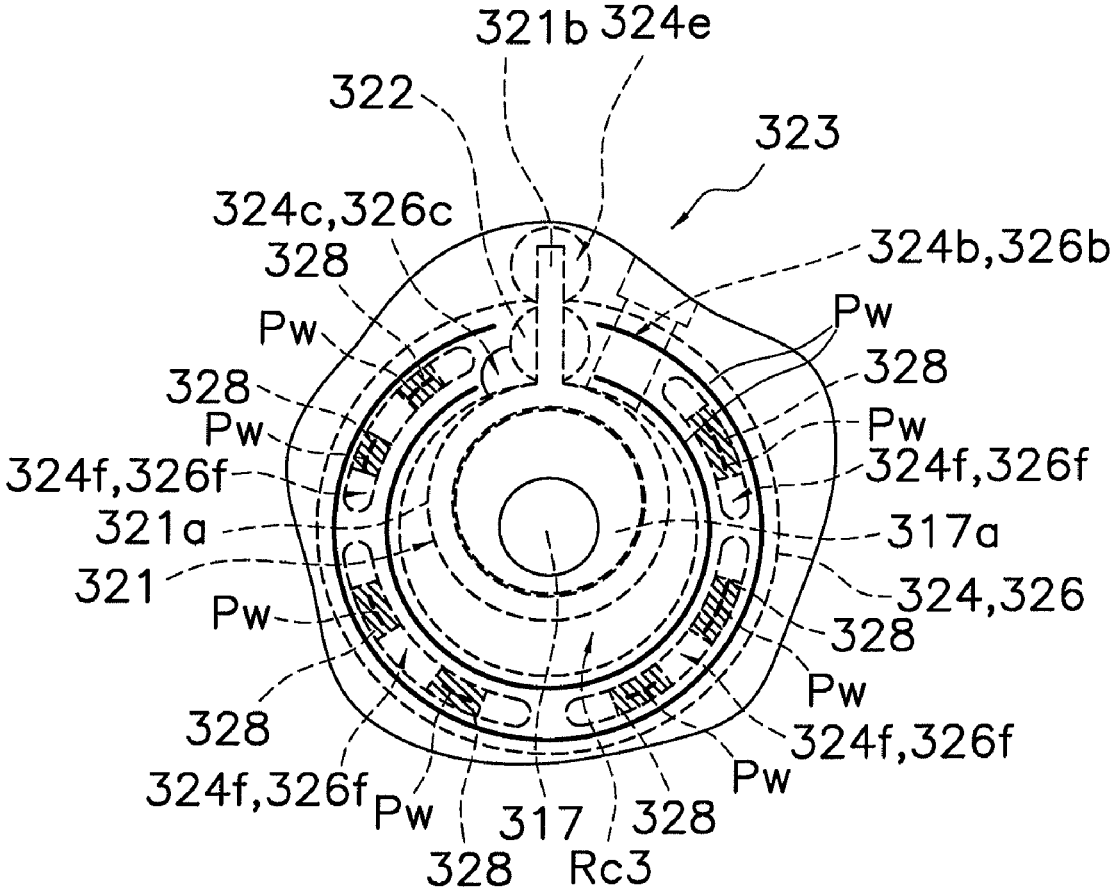
FIG. 23 is a drawing showing the penetration laser welded portions of the head according to modified example (B) of the third embodiment (the head is depicted partially).

In the swing compressor 301 according to the third embodiment, penetration laser welding is primarily performed non-continuously at positions in the heads 323, 325 corresponding to the areas between the cylinder hole 324*a* and the thermal insulation grooves 324*f* in the cylinder blocks 324, 326, and at positions in the heads 323, 325 corresponding to areas farther out than the thermal insulation grooves 324*f*, 326*f* in the cylinder blocks 324, 326; and the heads 323, 325 are joined to the cylinder blocks 324, 326. However, penetration laser welding may be performed continuously as shown in FIG. 23. The airtightness between the cylinder hole 324*a* and the thermal insulation holes 324*f* can thus be improved, as can the airtightness in the thermal insulation grooves 324*f*.

(C)

In the swing compressor 301 according to the third embodiment, the laser light rays LS are directed along the axis 301*a* of the crankshaft 317, but the direction of the laser light rays LS may also be inclined in relation to the axis 301*a* of the crankshaft 317 (for example, see FIG. 13 and modified example (C) of the second embodiment).

(D)

In the swing compressor 301 according to the third embodiment, the heads 323, 325 are joined by penetration laser welding to the cylinder blocks 324, 326. However, through-grooves may be provided at positions in the heads 323, 325 corresponding to the positions between the cylinder holes 324*a*, 326*a* and the thermal insulation grooves 324*f*, 326*f* in the cylinder blocks 324, 326, and at positions in the heads 323, 325 corresponding to the areas farther out than the thermal insulation grooves 324*f*, 326*f* in the cylinder blocks 324, 326; and the walls of these through-grooves may be fillet welded to the cylinder blocks 324, 326 (for example, see FIG. 14 and modified example (D) of the second embodiment). In such cases, laser welding may be performed using a filler, or laser welding may be performed without the use of a filler.

(E)

In the swing compressor 301 according to the third embodiment, four separate thermal insulation grooves 324*f*, 326*f* are formed, but thermal insulation holes may also be formed so that all of the thermal insulation grooves are in communication with each other.

(F)

In the swing compressor 301 according to the third embodiment, the rear head 325 is joined to the second cylinder block 326 by penetration laser welding, but the rear head 325 may also be joined to the second cylinder block 326 by fillet welding at positions separated outward by a distance of from 2 mm or more to 4 mm or less from the internal peripheral surface of the cylinder hole 326*a* in the second cylinder block 326 (see FIG. 15 and modified example (H) of the second embodiment). In such cases, laser welding may be performed using a filler, or laser welding may be performed without the use of a filler.

(G)

In the swing compressor 301 according to the third embodiment, the heads 323, 325 are joined to the cylinder blocks 324, 326 by penetration laser welding at positions corresponding to positions separated outward by 3 mm from the internal peripheral surface of the cylinder holes 324*a*, 326*a* in the cylinder blocks 324, 326, but the penetration laser welding can also be performed at positions in the heads 323, 325 corresponding to positions separated outward by a distance of from 2 mm or more to 4 mm or less from the internal peripheral surface of the cylinder holes 324*a*, 326*a* in the cylinder blocks 324, 326.

(H)

In the swing compressor 301 according to the third embodiment, the joining parts 328 are provided inside the thermal insulation grooves 324*f*, 326*f* of the cylinder blocks 324, 326 at the ends of the side opposite from the side on which the discharge channels 324*c*, 326*c* but these joining parts may also entirely cover the thermal insulation grooves 324*f*, 326*f*.

(I)

In the swing compressor 301 according to the third embodiment, the joining parts 328 are provided inside the thermal insulation grooves 324*f*, 326*f* of the cylinder blocks 324, 326 at the ends of the side opposite from the side on which the discharge channels 324*c*, 326*c*, but these joining parts may also be provided inside the thermal insulation holes

324*f*, 326*f* and may have a shape that protrudes from either the external peripheral side or internal peripheral side of the ends opposite from the sides on which the discharge channels 324*c*, 326*c* are formed.

(J)

Figure 24:
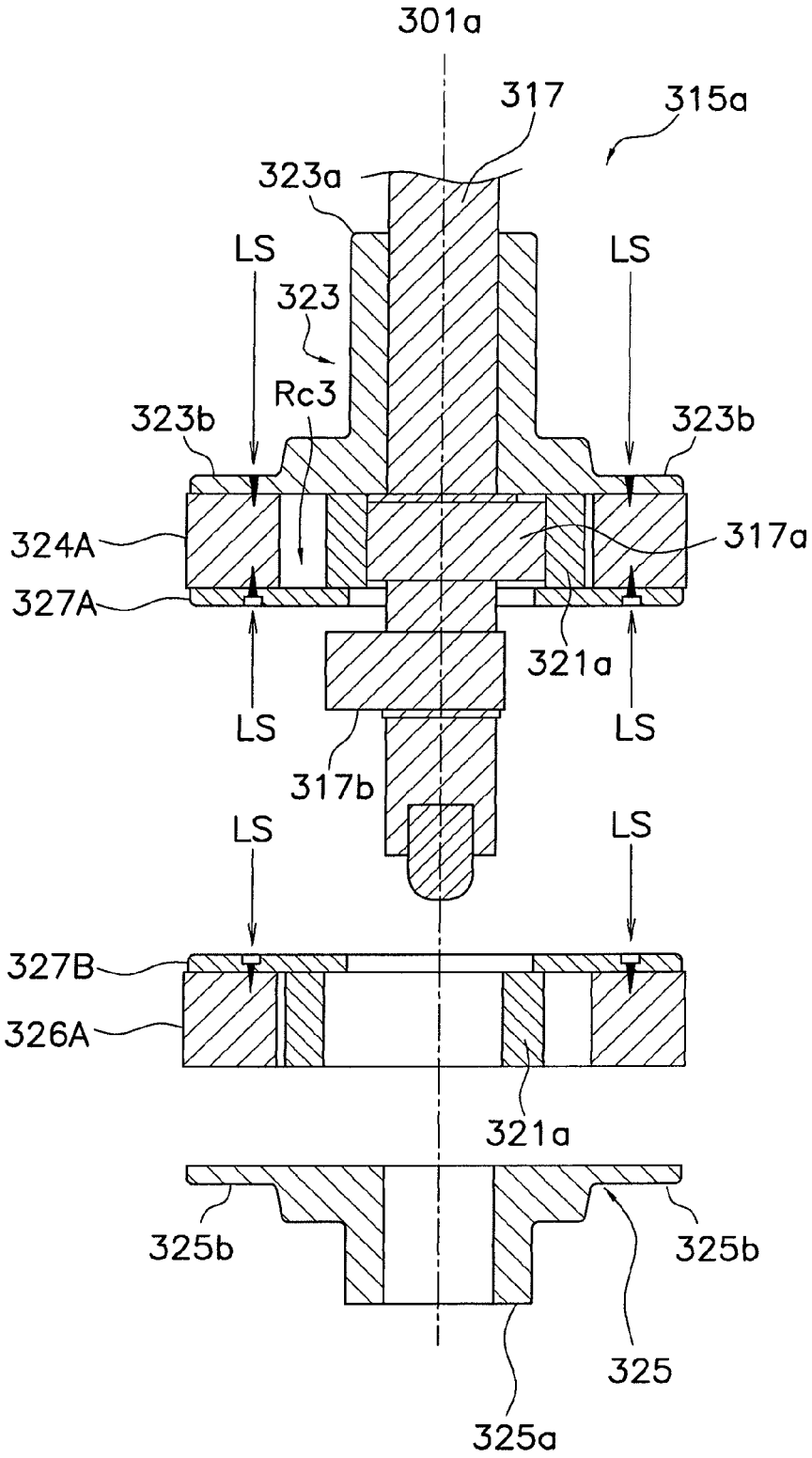
FIG. 24 is a drawing showing the method for assembling the swing compression mechanism according to modified example (J) of the third embodiment.
Figure 25:
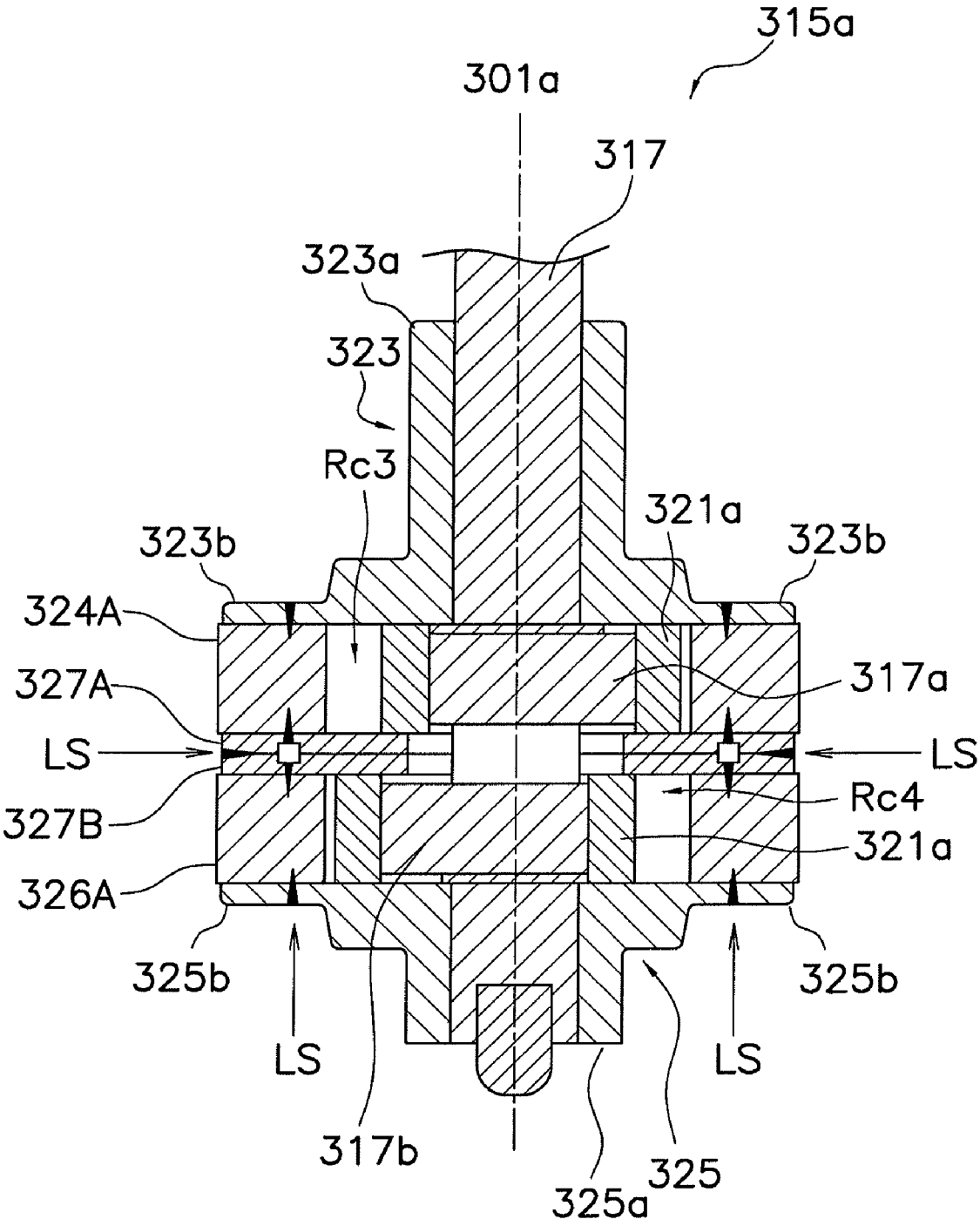
FIG. 25 is a drawing showing the method for assembling the swing compression mechanism according to modified example (J) of the third embodiment.

In the swing compressor 301 according to the third embodiment, the joining parts 328 of the cylinder blocks 324, 326 are joined to the middle plate 327 by penetration laser welding, and furthermore, the heads 323, 325 are joined to the cylinder blocks 324, 326 by penetration laser welding to assemble the two-cylinder type swing compression mechanism 315. However, the swing compression mechanism may also be assembled as shown in FIGS. 24 and 25. This assembly method is described hereinbelow.

The assembly method primarily comprises a first insertion step, a first clamping step, a first penetration laser welding step, a second penetration laser welding step, a second insertion step, a second clamping step, and a third penetration laser welding step.

In the first insertion step, the first cylinder block 324A is inserted through the crankshaft 317 so that the first eccentric shaft portion 317*a* of the crankshaft 317 is accommodated in the cylinder hole in the first cylinder block 324A. The first middle plate 327A is inserted through the crankshaft 317 so that the first middle plate 327A is positioned between the first eccentric shaft portion 317*a* and the second eccentric shaft portion 317*b* of the crankshaft 317. The front head 323 is then inserted through the crankshaft 317 from the drive motor 316 side of the crankshaft 317.

In the first clamping step, the front head 323, the first cylinder block 324A, and the first middle plate 327A are clamped together.

In the first penetration laser welding step, laser light rays LS is directed along the axial direction 301*a* of the crankshaft 317 onto the front head 323 and the middle plate 327A, and the front head 323 and first middle plate 327A are joined to the first cylinder block 324A. In the present modified example, the welded positions of the front head 323 and the first middle plate 327A are positions on the front head 323 and first middle plate 327A corresponding to positions separated outward by 3 mm from the internal peripheral surface of the cylinder hole in the first cylinder block 324A. To ensure that the piston 321 will swing and that the bushing 322 will rotate, penetration laser welding is not performed on the positions corresponding to the blade portion 321*b* of the piston 321 and the bushing 322.

In the second penetration laser welding step, the laser light rays LS is directed along the axial direction 301*a* of the crankshaft 317 onto a second middle plate 327B and the second middle plate 327B is joined to the second cylinder block 324B before the second cylinder block 324B and the second middle plate 327B are inserted through the crankshaft 317. This welded product is hereinafter referred to as the cylinder block with a second middle plate. In the present modified example, the welded positions of the second middle plate 327B are positions on the second middle plate 327B corresponding to positions separated outward by 3 mm from the internal peripheral surface of the cylinder hole in the second cylinder block 324B.

In the second insertion step, the cylinder block with a second middle plate is inserted through the crankshaft 317 so that the second middle plate 327B faces the first middle plate 327A. The rear head 325 is thereafter inserted through the crankshaft 317.

In the second clamping step, the cylinder block with a middle plate is clamped to the first middle plate 327A, and the rear head 325 is clamped to the second cylinder block 324B.

In the third penetration laser welding step, the laser light rays LS is directed along the axial direction 301*a* of the crankshaft 317 onto the rear head 325, and the rear head 325 is joined to the second cylinder block 324B, as shown in FIG. 24. In the present modified example, the welded positions of the rear head 325 are positions in the rear head 325 corresponding to positions separated outward by 3 mm from the internal peripheral surface of the cylinder hole in the second cylinder block 324B. In this third penetration laser welding step, the laser light rays LS is directed along the joined surface between the first middle plate 327A and the second middle plate 327B, and the first middle plate 327A and second middle plate 327B are joined together. The first middle plate 327A and the second middle plate 327B may be welded across the entire periphery, or may be welded in spots.

In the present modified example, the sequence of steps is not particularly limited as long as the resulting product is the same. For example, the second cylinder block 324B, the rear head 325, and the second middle plate 327B may be assembled first, and the first cylinder block 324A, the front head 323, and the first middle plate 327A may be assembled afterward. In the first insertion step, the first cylinder block 324A joined in advance with the front head 323 may be inserted through the crankshaft 317 from the drive motor 316 side of the crankshaft 317, or the first cylinder block 324A joined in advance with the first middle plate 327A may be inserted through the crankshaft 317. The second penetration laser welding step may be performed any time before the second insertion step. In the third penetration laser welding step, the first middle plate 327A and second middle plate 327B may be laser welded together before the rear head 325 and the second cylinder block 324B are joined by penetration laser welding.

(K)

In the swing compressor 301 according to the third embodiment, the joining parts 328 are provided inside the thermal insulation grooves 324*f*, 326*f* of the cylinder blocks 324, 326 at the ends of the side opposite from the side on which the discharge channels 324*c*, 326*c*, but these joining parts 328 may be omitted. In such cases, the cylinder blocks may be subjected to fillet laser welding along the end portions of the inside walls of the thermal insulation grooves and joined to the rear head.

(L)

In the swing compressor 301 according to the third embodiment, the joining parts 323*b*, 325*b* of the front head 323 and rear head 325 have a thickness of 2 mm, and the laser output during penetration laser welding is 4 to 5 kW. However, if the laser output is 4 to 5 kW, the thickness of the joining parts 323*b*, 325*b* can be 3 mm or less. In cases in which the laser output is increased, the thickness of the joining parts 323*b*, 325*b* may be increased to be greater than 3 mm. If the laser output cannot be increased to be greater than 4 kW, the thickness can be reduced.

Industrial Applicability

The compressor according to the present invention can be reduced in size and can be made commercially available at a low price. The compressor has the characteristics whereby the conventional slideability or machinability is preserved, and is useful as a compressor that is placed in a small installation space.

What is claimed is:

1. A compressor comprising:

a first constituent element configured to be laser welded, the first constituent element having a first joining surface; and a first slider composed of cast iron that is configured to be laser welded and having a carbon content of at least 2.0 wt % and no more than 2.7 wt %, the first slider having a second joining surface.

the first slider being joined with the first constituent element by laser welding without using a filler, with at least 50% of a contact portion between the first joining surface and the second joining surface being laser welded without using a filler, the first constituent element includes a chamfered edge formed in an end portion of the first joining surface on a side irradiated with laser light when laser welded, the chamfered edge of the first constituent element having a width that is smaller than ¼ of a spot diameter of the laser light, and the first slider includes a chamfered edge formed in an end portion of the second joining surface on a side irradiated with laser light when laser welded, the chamfered edge of the first slider having a width that is smaller than ¼ of the spot diameter of the laser light.

2. The compressor as recited in claim 1, wherein the contact portion between the first joining surface and the second joining surface is welded across an entire periphery thereof.

3. The compressor as recited in claim 1, wherein the first constituent element has a first plate part and a first enclosing wall part formed upright on the first plate part;

the first joining surface is an end surface of the first enclosing wall part on a side opposite from the first plate part;

the first slider has a second plate part and a second enclosing wall part formed upright on the second plate part; and the second joining surface is an end surface of the second enclosing wall part on a side opposite from the second plate part.

4. The compressor as recited in claim 3, further comprising:

a second slider disposed in a space formed by the first enclosing wall part and the second enclosing wall part when the first joining surface and the second joining surface face each other, the first constituent element further having a third wall part including a surface that intersects a direction of laser light propagation during laser welding, the third wall part being provided between an inner wall surface of the first enclosing wall part and the second slider when the first joining, surface and the second joining surface ace each other.

5. The compressor as recited in claim 3, further comprising:

a second slider disposed in a space formed by the first enclosing wall part and the second enclosing wall part when the first joining surface and the second joining surface face each other, the first slider further having a fourth wall part including a surface that intersects a direction of laser light propagation during laser welding, the fourth wall part being provided between an inner wall surface of the second enclosing wall part and the second slider.

6. The compressor as recited in claim 1, wherein carbon dioxide is compressed.

7. A compressor comprising:

a first constituent element configured to be laser welded, the first constituent element having a first joining surface, a first plate part and a first enclosing wall formed upright on the first plate part, with the first joining surface being an end surface of the first enclosing wall part on a side opposite from the first plate part;

a first slider composed of cast iron that is configured to be laser welded and having a carbon content of at least 2,0 wt % and no more than 2.7 wt %, the first slider having a second joining surface, a second plate part and a second enclosing wall part formed upright on the second plate part, with the second joining surface being an end surface of the second enclosing wall part on a side opposite from the second plate part; and a second slider disposed in a space formed by the first enclosing wall part and the second enclosing wall part when the first joining surface and the second joining surface face each other, the first slider being joined with the first constituent element by laser welding without using a filler, with at least 50% of a contact portion between the first joining surface and the second joining surface being laser welded without using a filler, and the first constituent element further having a third wall part including a surface that intersects a direction of laser light propagation during laser welding, the third wall part being provided between an inner wall surface of the first enclosing wall part and the second slider when the first joining surface and the second joining surface face each other.

8. A compressor comprising:

a first constituent element configured to be laser welded, the first constituent element having a first joining surface, a first plate part and a first enclosing wall part formed upright on the first plate part with the first joining surface being an end surface of the first enclosing wall part on a side opposite from the first plate part:

a first slider composed of cast iron that is configured to be laser welded and having a carbon content of at least 2.0 wt % and no more than 2.7 wt %, the first slider having a second joining surface, a second plate part and a second enclosing wall part formed upright on the second plate part, with the second joining surface being an end surface of the second enclosing wall part on a side opposite from the second plate part; and a second slider disposed in a space formed by the first enclosing wall part and the second enclosing wall part when the first joining surface and the second joining surface face each other, the first slider being joined with the first constituent element by laser welding without using a filler, with at least 50% of a contact portion between the first joining surface and the second joining surface being laser welded without using a filler, and the first slider further having a fourth wall part including a surface that intersects a direction of laser light propagation during laser welding, the fourth wall part being provided between an inner wall surface of the second enclosing wall part and the second slider.

* * * * *

UNITED STATES PATENT AND TRADEMARK OFFICE

CERTIFICATE OF CORRECTION

PATENT NO. : 8,167,596 B2
APPLICATION NO. : 12/281028
DATED : May 1, 2012
INVENTOR(S) : Mitsuhiko Kishikawa et al.

It is certified that error appears in the above-identified patent and that said Letters Patent is hereby corrected as shown below:

Column 37,
Line 47, "first joining, surface and the second joining surface ace" should read -- first joining surface and the second joining surface face --.

Column 38,
Line 4, "face, a first plate part and a first enclosing wall formed" should read -- face, a first plate part and a first enclosing wall part formed --.

Column 38,
Line 9, "laser welded and having a carbon content of at least 2,0" should read -- laser welded and having a carbon content of at least 2.0 --.

Column 38,
Line 36, "formed upright on the first plate part with the first joining" should read -- formed upright on the first plate part, with the first joining --.

Signed and Sealed this
Tenth Day of July, 2012

David J. Kappos

David J. Kappos
*Director of the United States Patent and Trademark Office*